US009276310B1

(12) United States Patent
Apel

(10) Patent No.: US 9,276,310 B1
(45) Date of Patent: Mar. 1, 2016

(54) OMNIDIRECTIONAL HELICALLY ARRAYED ANTENNA

(76) Inventor: Thomas R. Apel, Austin, TX (US)

( * ) Notice: Subject to any disclaimer, the term of this patent is extended or adjusted under 35 U.S.C. 154(b) by 716 days.

(21) Appl. No.: 13/341,915

(22) Filed: Dec. 31, 2011

(51) Int. Cl.
*H01Q 1/36* (2006.01)

(52) U.S. Cl.
CPC ..... *H01Q 1/362* (2013.01)

(58) Field of Classification Search
USPC ..... 343/859, 860, 866, 867, 895
See application file for complete search history.

(56) References Cited

U.S. PATENT DOCUMENTS

| | | | | | |
|---|---|---|---|---|---|
| 2,897,459 | A | * | 7/1959 | Stark | 333/163 |
| 3,031,668 | A | * | 4/1962 | Bryson | 343/790 |
| 4,697,192 | A | * | 9/1987 | Hofer et al. | 343/895 |
| 5,191,352 | A | * | 3/1993 | Branson | 343/895 |
| 5,255,005 | A | * | 10/1993 | Terret et al. | 343/895 |
| 6,011,524 | A | * | 1/2000 | Jervis | 343/895 |

OTHER PUBLICATIONS

Brown, G.H., "The 'Turnstile' Antenna," Electronics, Apr. 1936, pp. 14-17, 48.

Stites, F.H., "A 'Halo' for Six Meters," QST, Oct. 1947, pp. 24-27, American Radio Relay League, Newington, CT 06111-1494.

Mellen, R.H., and Milner, C.T., "The Big Wheel on Two," QST, Sep. 1961, pp. 42-45, American Radio Relay League, Newington, CT 06111-1494.

Cebik, L.B., and Cerreto, R., "A New Spin on the Big Wheel," pp. 30-34, American Radio Relay League, Newington, CT 06111-1494.

Apel, T.R., "A New Horizontal Polarized High Gain Omni-Directional Antenna," QEX, Nov./Dec. 2011, pp. 1-7, American Radio Relay League, Newington, CT 06111-1494.

* cited by examiner

*Primary Examiner* — Tho G Phan

(57) ABSTRACT

A method and apparatus for an omnidirectional helically arrayed antenna are described. In accordance with at least one embodiment, a horizontally polarized omnidirectional helically arrayed antenna is provided. In accordance with at least one embodiment, an antenna comprises a helical array of coaxial transmission line radiating elements coupled to one another successively by phase changing couplings. In accordance with at least one embodiment, the antenna is configured to provide an omnidirectional radiation pattern and a polarization dominated by a magnetic field vector component parallel to an axis of the helical array and an electric field vector component perpendicular to the axis of the helical array. In accordance with at least one embodiment, an electrical length of each of the coaxial transmission line radiating elements is an odd integer multiple of a half wavelength in the coaxial medium with a pitch in the range of 0.35 wavelength to 0.50 wavelength.

20 Claims, 17 Drawing Sheets

OMNIDIRECTIONAL HELICALLY ARRAYED ANTENNA

CROSS-REFERENCE TO RELATED APPLICATIONS

BACKGROUND OF THE INVENTION

1. Field of the Invention

The present invention relates generally to antennas and, more particularly, to horizontally polarized omnidirectional antennas.

2. Description of the Related Art

High gain omnidirectional antennas are more difficult to realize with horizontal polarization than with vertical polarization. Vertical radiating elements stacked along a vertical line provide a natural means of achieving high gain with vertical polarization. Radiating elements often have a length of λ/2 or near λ/2. When these elements are rotated to a horizontal mode, the familiar bidirectional dipole azimuth pattern is seen. Turnstile arrays, such as those described in Brown, G. H, "The Turnstile Antenna" Electronics, April 1936, and Masters, D. W., "The Super-turnstile Antenna" Broadcast News, January 1946, were early answers to the challenge of omnidirectional performance with horizontal polarization. Dipoles also have been wrapped into circular ("halo") shapes, as described, for example, in Stites, F. H., "A Halo for Six Meters" QST, October 1947, or square ("squalo") shapes to mitigate the pattern; however, gain is reduced. Perhaps the best implementation of circularly wrapped dipoles is the Big Wheel, where three dipoles form a circular array, as described in Mellen, R. H., and Milner, C. T., "The Big Wheel on Two" QST, September 1961. An excellent printed board implementation has been done by Kent Britain (WA5VJB). Basic performance of the "halo" and "big wheel" structures has been extended by use of folded dipole elements. The folded dipole "halo" has been done by Delbert Fletcher (K5DDD) and the folded dipole "super wheel" is credited to Tom Haddon (K5VH). Slots in cylinders or in rectangular wave guides have offered another approach to horizontal polarization at higher frequencies where λ/2 elements become quite small. The work of Cebik and Cerreto should also be mentioned for a three dipole array that yields a far field radiation pattern nearly identical to that of the "big wheel" as a result of the similarity in current distribution on the three dipoles to that of arrays of three dipoles around a circle.

However, to achieve high gain using such antennas requires stacking an array of horizontally polarized unit structures. The feed complexity associated with ten or twelve stacked structures is not trivial. Thus, a horizontally polarized omnidirectional antenna that provides high gain without complicated feed arrangements is needed.

BRIEF DESCRIPTION OF THE SEVERAL VIEWS OF THE DRAWINGS

The present invention may be better understood, and its features made apparent to those skilled in the art by referencing the accompanying drawings.

The use of the same reference symbols in different drawings indicates similar or identical items.

DETAILED DESCRIPTION OF THE INVENTION

Figure 1:
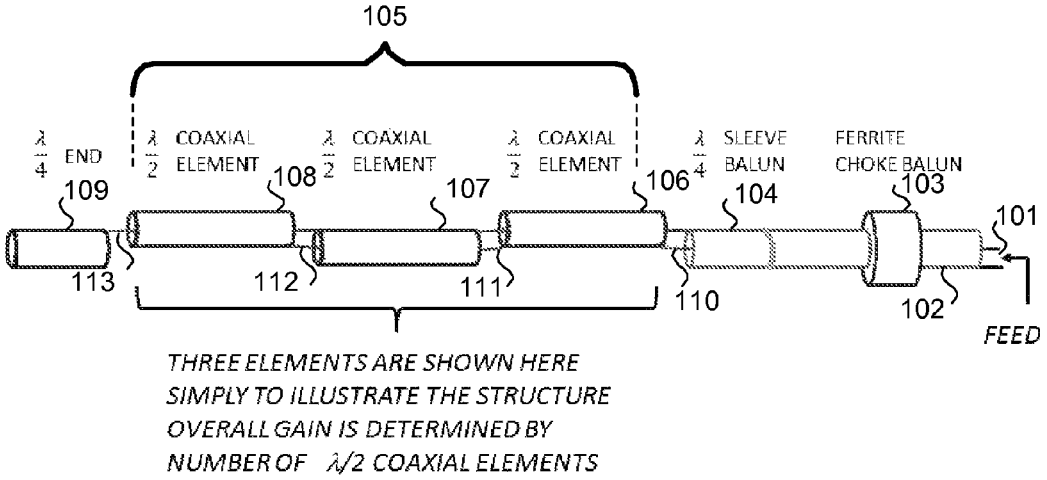
FIG. 1 is a diagram illustrating an uncoiled coaxial collinear structure that does not provide horizontal polarization omnidirectionally.

A method and apparatus for an omnidirectional helically arrayed antenna are described. In accordance with at least one embodiment, a horizontally polarized omnidirectional helically arrayed antenna is provided. To understand concepts of omnidirectionality and polarization, it can be helpful to first think of a theoretical isotropic radiator that radiates and receives equally in all directions. However, despite its conceptual simplicity, a truly isotropic radiator is difficult to implement in practice and, even if it could be practically implemented, would often be disadvantageous. For example, for terrestrial applications, radiating power into the earth or into the sky may be inefficient when other stations are located elsewhere on or near the surface of the earth, not in the sky or in the earth. Rather, it can be useful to implement an antenna to provide an anisotropic pattern with gain in certain directions relative to the isotropic pattern of a theoretical isotropic radiator. While some antennas, such as parabolic dish antennas, provide gain only in a single direction, it can often be useful to provide gain in a generally circular, or "pancake" pattern, which can be oriented to direct radiation toward the horizon in a 360° circular pattern, referred to as an omnidirectional pattern. Thus, an omnidirectional antenna need not have an isotropic pattern but merely a roughly circularly symmetric pattern about an axis of symmetry, for example, a roughly circular "pancake" pattern or, as another example, a roughly toroidal pattern.

Electromagnetic signals comprise an electric component and a magnetic component, wherein the electric component and the magnetic component are oriented orthogonally to each other. Polarization of electromagnetic signals is discussed with respect to the orientation of the electric component. It is typical for omnidirectional antennas to be vertically polarized, wherein the orientation of the electric component of electromagnetic waves they radiate is parallel to the axis of symmetry of an omnidirectional antenna. Such antennas can be very simple, such as a straight piece of wire a quarter wavelength long.

However, horizontal polarization is sometimes desirable. For example, given the large number of electromagnetic sources that emit vertically polarized radiation, use of horizontal polarization can greatly reduce any interference from vertically polarized sources. Thus, a horizontally polarized omnidirectional antenna, which radiates electromagnetic waves having the magnetic component, not the electric component, oriented parallel to the axis of symmetry of its omnidirectional pattern. Thus, the electric component of its electromagnetic waves is oriented perpendicular to the axis of symmetry. When a horizontally polarized omnidirectional antenna is oriented so its axis of symmetry is perpendicular to the surface of the earth, as is often the case, such an orientation radiates electromagnetic waves having an electric component parallel to the horizon. Given antenna reciprocity, antenna characteristics that apply to transmission, wherein the antenna is radiating electromagnetic waves, also apply to reception, wherein the antenna is receiving electromagnetic waves. Thus, discussion of radiation of electromagnetic waves of a particular polarization should be understood to apply also to reception of electromagnetic waves of such polarization. As another example, discussion of omnidirectionality and/or gain in the context of transmission of electromagnetic waves should be understood to apply also to reception of electromagnetic waves.

Horizontally polarized antennas are useful for numerous applications. As an example, amateur radio weak signal communications typically use horizontally polarized antennas. As another example, television stations typically use horizontally polarized antennas. As yet another example, FM broadcast radio stations typically use either horizontally polarized antennas or antennas of another polarization that comprises a horizontal component and in compatible with horizontal polarization, such as elliptical polarization. As a further example, horizontally polarized antennas are sometimes used for communicating with mobile devices, which, by virtue of their mobility, may be operated with a random orientation and, therefore, have a random antenna polarization. As another example, horizontally polarized antennas are sometimes used as part of a diversity antenna system. As yet another example, horizontally polarized antennas are sometimes used in orthogonal antenna systems designed to distinguish between horizontally polarized signals and vertically polarized signals.

In theory, electromagnetic radiation may be considered, for example, as purely horizontally or purely vertically polarized. However, in practice, it is possible for electromagnetic to have arbitrary polarization, including time varying polarization (e.g., in the cases of elliptically polarized antennas, including circularly polarized antennas and when a transmitter is moving, when objects in the environment are moving, or when the environment is otherwise changing in a way that affects electromagnetic radiation). If the polarization of the electric field of an electromagnetic wave is represented by a Euclidean vector, such a vector can be decomposed into vertical electric vector component and a horizontal electric vector component. If the polarization is diagonal at a 45° angle, the vertical electric vector component and the horizontal electric vector component are of equal magnitude, and in-phase. If phase is offset (i.e., if the phase of the vertical electric vector component leads or lags the phase of the horizontal electric vector component) by 90 degrees, circular polarization results. If the polarization is closer to horizontal than vertical, the horizontal electric vector component has a greater magnitude than the vertical electric vector component. If the polarization is closer to vertical than horizontal, the vertical electric vector component has a greater magnitude than the horizontal electric vector component. While a helically arrayed antenna, in accordance with at least one embodiment, may have a substantially greater horizontal electric vector component than its vertical electric vector component, especially at finer pitches of the helix, the pitch of the helix results in some non-zero vertical electric vector component. If the horizontal electric vector component (i.e., the electric vector component perpendicular to the axis of the helical array) is greater than the vertical electric vector component (i.e., the electric vector component parallel to the axis of the helical array), the horizontal electric vector component dominates over the vertical electric vector component and provides effective horizontally polarized communication while still providing some rejection of any vertically polarized interference that may be present. Moreover, the gain of the antenna, which, in accordance with at least one embodiment, tends to increase as pitch of the helix increases can increase the strength of the horizontally polarized component of the electromagnetic signal within a main lobe of the antenna pattern, thereby more than offsetting any reduction in the strength of the horizontally polarized component as it decreases and the vertically polarized component increases with increasing pitch of the helix. However, as the pitch continues to increase beyond an optimal value for horizontally polarized use, the vertically polarized component continues to increase and the horizontally polarized component continues to decrease at a rate greater than any increased gain can compensate. In accordance with at least one embodiment, such an optimal value appears to be approximately 0.38 times the wavelength of operation.

In accordance with at least one embodiment, the pitch is increased substantially beyond 0.38 times the wavelength of operation to allow the vertically polarized component to dominate over the horizontally polarized component, which can be useful for applications that are vertically polarized or predominantly vertically polarized.

In situations where the polarization of signals may vary, such as with mobile devices that may be held in different orientations, rejection of orthogonal polarization vector components may not be desirable. To more universally accommodate various polarization angles, techniques such as antenna diversity are sometimes employed. Antenna diversity attempts to strike a compromise that allows effective communication regardless of polarization angle. In accordance with at least one embodiment, a helix pitch may be chosen to provide some substantial amount of vertical electric vector component and some substantial amount of horizontal electric vector component. As one example, a helix pitch may be chosen to balance the vertical electric vector component with the horizontal electric vector component. As another example, a helix pitch may be chosen to provide somewhat more vertical electric vector component than horizontal electric vector component, for example to compensate for a somewhat greater noise floor typically experienced with vertical polarization than with horizontal polarization. In accordance with at least one embodiment, two counter wound helical arrays (i.e., a first helical array implemented with a right hand twist and a second helical array implemented with a left hand twist) may be used to provide opposite angles of diagonal polarization to increase antenna diversity.

In accordance with at least one embodiment, a method for providing a helically arrayed antenna comprises joining a first odd half wavelength multiple coaxial element to a second odd half wavelength multiple coaxial element; joining the second odd half wavelength multiple coaxial element to a third odd half wavelength multiple coaxial element; arcuately forming the first odd half wavelength multiple coaxial element; arcuately forming the second odd half wavelength multiple coaxial element; and arcuately forming the third odd half wavelength multiple coaxial element. In accordance with at least one embodiment, at least the first odd half wavelength multiple coaxial element, the second odd half wavelength multiple coaxial element, and the third odd half wavelength multiple coaxial element are physically transformed from being separate coaxial elements to being an omnidirectional helically arrayed antenna, wherein the previously separate coaxial elements undergo transformation to become an integral assembly structurally and functionally different from the coaxial elements themselves. The odd half wavelength multiples are relative to wavelength in the coaxial medium, where a wavelength in the coaxial medium may be physically shorter than the same wavelength in free space, as the dielectric constant of the coaxial medium may result in a velocity of propagation through the coaxial medium of less than the speed of light in free space. A helically arrayed antenna is an antenna comprising an array of antenna elements, wherein the elements are arranged along a helix. As an example, flexible antenna elements are formed to be segments of a helix. As another example, rigid antenna elements are arranged to be tangential to a helix. Arcuately forming elements involves causing the elements to take the form of an arc. As a helix is three dimensional and a circle is two dimensional, an arc is usually understood to be two dimensional. However, as a segment of a helix closely approximates an arc and the flexibility of typical coaxial transmission line material can usually accommodate any difference between an arc and a segment of a helix, arcuately forming an element should be understood to include forming the element into an arc, a segment of a helix, or any other curved shape out of which a helix can be constructed, given the material properties of the materials used. An odd half wavelength multiple coaxial element is an element having a coaxial transmission line structure and an electrical length equal to an odd integer multiple of half the wavelength of operation (i.e., the wavelength for which the antenna is to be used). Examples include but are not limited to half the wavelength, one and a half times the wavelength, two and a half times the wavelength, three and a half times the wavelength, etc.

In accordance with at least one embodiment, the joining the first odd half wavelength multiple coaxial element to the second odd half wavelength multiple coaxial element further comprises joining a first center conductor of the first odd half wavelength multiple coaxial element to a second shield conductor of the second odd half wavelength multiple coaxial element; and joining a first shield conductor of the first odd half wavelength multiple coaxial element to a second center conductor of the second odd half wavelength multiple coaxial element. In accordance with at least one embodiment, the arcuately forming the first odd half wavelength multiple coaxial element further comprises forming the first odd half wavelength multiple coaxial element into a first portion of a helix, wherein the arcuately forming the second odd half wavelength multiple coaxial element further comprises forming the second odd half wavelength multiple coaxial element into a second portion of the helix, wherein the arcuately forming the third odd half wavelength multiple coaxial element further comprises forming the third odd half wavelength multiple coaxial element into a third portion of the helix.

In accordance with at least one embodiment, a terminal element is coupled to a distal end of the helical array. In accordance with at least one embodiment, a balun element is coupled to a proximal end of the helical array. In accordance with at least one embodiment, the method further comprises joining an odd quarter wavelength multiple coaxial element to the third odd half wavelength multiple coaxial element; and arcuately forming the odd quarter wavelength multiple coaxial element. In accordance with at least one embodiment, the method further comprises joining a balun element to the first odd half wavelength multiple coaxial element.

In accordance with at least one embodiment, the first odd half wavelength multiple coaxial element, the second odd half wavelength multiple coaxial element, and the third odd half wavelength multiple coaxial element together define a first turn of a helix. In accordance with at least one embodiment, the helix has a pitch less than a half wavelength in free space. In accordance with at least one embodiment, the helix has a pitch between a quarter of a wavelength and half of a wavelength, wherein the first odd half wavelength multiple coaxial element has an electrical length that is an odd integer multiple of half of the wavelength. In accordance with at least one embodiment, the helix has a pitch between half the electrical length of the first odd half wavelength multiple coaxial element and the electrical length of the first odd half wavelength multiple coaxial element. The electrical length is the physical length divided by the velocity of propagation, as a fraction of the speed of light, of a signal through that length. As an example, if an element has a propagation velocity constant of 0.685, its velocity of propagation is 0.685 times the speed of light, and the element has a physical length equal to its length measurement using a mechanical measuring device, such as a ruler or caliper, but an electrical length equal to the physical length divided by 0.685 (its propagation velocity constant), which is longer than the physical length due to the effective delay caused by the velocity of propagation being lower than the speed of light.

In accordance with at least one embodiment, an apparatus comprises a first coaxial element; a second coaxial element, wherein a first end of the second coaxial element is coupled phase discontinuously to the first coaxial element; a third coaxial element, wherein the third coaxial element is coupled phase discontinuously to a second end of the second coaxial element, wherein at least a portion of a helix is formed by the first coaxial element, the second coaxial element, and the third coaxial element. In accordance with at least one embodiment, the portion of the helix formed by the first coaxial element, the second coaxial element, and the third coaxial element is a first turn of the helix. An element being coupled phase discontinuously to another element means the element is coupled in a manner that changes the phase of a signal being passed from one element to the other element relative the phase that would otherwise exist if element were coupled to the other element by a straight coupling. As an example, in accordance with at least one embodiment, connection of the center conductor of one element to the shield conductor of the other element and of the shield conductor of the one element to the center conductor of the other element introduces a phase change of 180° relative to the phase that would otherwise exist from a straight coupling. As another example, in accordance with at least one embodiment, a phasing stub introduces a phase change relative to the phase that would otherwise exist from a straight coupling. As yet another example, in accordance with at least one embodiment, a phasing coil introduces a phase change relative to the phase that would otherwise exist from a straight coupling. As a further example, in accordance with at least one embodiment, a lumped reactance phasing element introduces a phase change relative to the phase that would otherwise exist from a straight coupling.

In accordance with at least one embodiment, the first coaxial element, the second coaxial element, and the third coaxial element each have an electrical length of half a wavelength of operation. In accordance with at least one embodiment, the pitch of the helix is between a quarter wavelength of operation and a half the wavelength of operation. In accordance with at least one embodiment, the pitch of the helix is between 0.38 times a wavelength of operation and 0.40 times the wavelength of operation.

In accordance with at least one embodiment, a first physical length of the first coaxial element divided by a first propagation velocity constant of first coaxial element is greater than the pitch of the helix, wherein a second physical length of the second coaxial element divided by a second propagation velocity constant of the second coaxial element is greater than the pitch of the helix, and wherein a third physical length of the third coaxial element divided by a third propagation velocity constant of the third coaxial element is greater than the pitch of the helix. In accordance with at least one embodiment, a first physical length of the first coaxial element divided by a first propagation velocity constant of first coaxial element is between one times the pitch of the helix and two times the pitch of the helix, wherein a second physical length of the second coaxial element divided by a second propagation velocity constant of the second coaxial element is between one times the pitch of the helix and two times the pitch of the helix, and wherein a third physical length of the third coaxial element divided by a third propagation velocity constant of the third coaxial element is between one times the pitch of the helix and two times the pitch of the helix.

In accordance with at least one embodiment, the apparatus further comprises a fourth coaxial element, wherein the fourth coaxial element is coupled phase discontinuously to the third coaxial element; a fifth coaxial element, wherein the fifth coaxial element is coupled phase discontinuously to the fourth coaxial element; a sixth coaxial element, wherein the sixth coaxial element is coupled phase discontinuously to the fifth coaxial element, wherein the helix further comprises the fourth coaxial element, the fifth coaxial element, and the sixth coaxial element. In accordance with at least one embodiment, the first coaxial element, the second coaxial element, and the third coaxial element define a first turn of the helix and wherein the fourth coaxial element, the fifth coaxial element, and the sixth coaxial element define a second turn of the helix.

In accordance with at least one embodiment, the apparatus further comprises a terminal coaxial element coupled to a distal end of an array of coaxial elements comprising the first coaxial element, the second coaxial element, the third coaxial element, the fourth coaxial element, the fifth coaxial element, and the sixth coaxial element, wherein the helix comprises the first coaxial element, the second coaxial element, the third coaxial element, the fourth coaxial element, the fifth coaxial element, and the sixth coaxial element, and the terminal coaxial element; and a balun element coupled to a proximal end of the array of coaxial elements.

In accordance with at least one embodiment, an antenna comprises a helical array of coaxial transmission line radiating elements coupled to one another successively by phase changing couplings. The helical array means the coaxial transmission line radiating elements are arranged along a helix. The coaxial transmission line radiating elements are elements that function as coaxial transmission lines and also radiate a signal (or, according to the inherent antenna property of reciprocity, receive a signal). It is understood that a transmission line need not be of the form of a one dimensional mathematical line but may be straight or curved or of other arbitrary form as long as it provides the function of conveying an electromagnetic signal as would a classical transmission line. Coupling of the elements to one another successively means that a distal end of one element is coupled to a proximal end of another element, with the distal end of that element being coupled to the proximal end of the next element. Coupling by phase changing couplings means that the phase of a signal passing through the coupling is changed relative to the phase that would otherwise result from a straight coupling. In accordance with at least one embodiment, an electrical length of each of the coaxial transmission line radiating elements is an odd integer multiple of a value greater than the pitch of the helical array. In accordance with at least one embodiment, an electrical length of each of the coaxial transmission line radiating elements is an odd integer multiple of a value between 1.25 times a pitch of the helical array and 1.32 times the pitch of the helical array. In accordance with at least one embodiment, the antenna is configured to provide an omnidirectional radiation pattern and a polarization dominated by a magnetic field vector component parallel to an axis of the helical array and an electric field vector component perpendicular to the axis of the helical array. In accordance with at least one embodiment, the antenna further comprises a terminal element coupled to a distal end of the helical array; a balun element coupled to the proximal end of the helical array; a radome enclosing the balun element, the helical array, and the terminal array; and a coaxial connector coupled to the balun element.

In accordance with at least one embodiment, a helically arrayed antenna comprises a single turn of coaxial radiating elements. In accordance with at least one embodiment, the single turn of coaxial radiating elements is coupled, on a distal end, to a terminal element and, on a proximal end, to a balun element. In accordance with at least one embodiment, a helically arrayed antenna comprises multiple turns of coaxial radiating elements.

In accordance with at least one embodiment, there is less than one element per turn. In accordance with at least one embodiment, there is one element per turn. In accordance with at least one embodiment, there are two elements per turn.

In accordance with at least one embodiment, there are three elements per turn. In accordance with at least one embodiment, there are more than three elements per turn.

In accordance with at least one embodiment, electromagnetic radiation is radiated or received from the shield conductors of the coaxial elements, while the center conductors of the coaxial elements act as transmission lines providing a propagation delay, which can be thought of as a phase delay, as a function of their electrical length, which is a function of their physical length and their velocity of propagation, which is a function of the dielectric constant of the dielectric material between their center conductors and their shield conductors. The electrical length of a coaxial element is its physical length divided by its velocity of propagation.

In accordance with at least one embodiment, the elements of the helical array are coupled phase discontinuously by joining them with phase changing couplings. For example, by connecting a first element center conductor of a first element distal end of a first coaxial element to a second element shield conductor of a second element proximal end of a second coaxial element and by connecting a first element shield conductor of the first element distal end of the first coaxial element to a second element center conductor of the second element proximal end of the second coaxial element, the phase of the signal propagating through the helical array is inverted, which constitutes a 180° phase change, thereby introducing a phase discontinuity. In accordance with at least one embodiment, coaxial elements of the helical array that are electrically one half wavelength long, provide a propagation delay that results in a 180° phase change, so combining a propagation delay 180° phase change of a coaxial element's propagation delay with a phase changing coupling 180° phase change phase change of a phase changing coupling joining the coaxial element to the successive coaxial element in the helical array introduces a total phase shift of 360° (equivalent to 0° (no net phase change)) between a proximal end of the coaxial element and the proximal end of the successive coaxial element. Accordingly, each successive coaxial element may be fed in phase with the coaxial element it succeeds, thereby allowing the helical array to provide a radiation pattern based on the superposition of the radiation of the several coaxial elements.

While alternating shield conductors and center conductors between coaxial elements and their succeeding coaxial elements is a simple, effective way to introduce an instant phase inversion with minimal parasitic phenomena and minimal impedance discontinuity, other phase changing couplings may be employed. For example, in accordance with at least one embodiment, a hairpin stub may be used as a phase changing coupling. As another example, in accordance with at least one embodiment, a phasing coil may be used as a phase changing coupling. As yet another example, in accordance with at least one embodiment, a lumped reactance element may be used as at least part of a phase changing coupling.

In accordance with at least one embodiment, the antenna is end fed from a proximal end of the helical array. In accordance with at least one embodiment, a balun element is coupled to the proximal end of helical array, and the helical array is fed through the balun element. In accordance with at least one embodiment, the antenna is center fed from a proximal end of a first helical array and a proximal end of a second helical array, wherein the distal end of the first helical array and the distal end of the second helical array lie opposite one another along a common axis of the first helical array and the second helical array. In accordance with at least one embodiment, a common feed point for first helical array and the second helical array helps lower the feed point impedance, which can be beneficial, especially for shorter helical arrays (i.e., helical arrays of fewer elements). An optimal number of coaxial elements of the first helical array and the second helical array may be selected to optimize matching of the feed point impedance. In accordance with at least one embodiment, the first helical array and the second helical array may be formed with the same direction of twist. In accordance with at least one embodiment, the first helical array and the second helical array may be formed with opposite directions of twist.

In accordance with at least one embodiment, a helical array may have a right hand twist. In accordance with at least one embodiment, a helical array may have a left hand twist. In accordance with at least one embodiment, a helical array may be arranged along a cylindrical helix. In accordance with at least one embodiment, each turn of a helical array may comprise an integer number of coaxial elements. In accordance with at least one embodiment, each turn of a helical array may comprise a non-integer number of coaxial elements. In accordance with at least one embodiment, the lengths of coaxial elements of a cylindrical helix may vary. In accordance with at least one embodiment, a helical array may be arranged along a conical helix. A conical helix has application over wide bandwidth with a commensurate reduction in gain. In accordance with at least one embodiment, a single conical helix is implemented. In accordance with at least one embodiment, two conical helices are center fed to form a biconical assembly of the two conical helices. In accordance with at least one embodiment, the lengths of coaxial elements of a helical array may be the same. In accordance with at least one embodiment, the lengths of coaxial elements of a helical array may be different. An array with a plurality of lengths may be viewed as a combination of uniform length subarrays, with multiband application. In accordance with at least one embodiment, the lengths of coaxial elements of a conical helical array may vary so as to maintain an integer number of coaxial elements per turn. In accordance with at least one embodiment, the lengths of coaxial elements of a conical helical array may vary so as to result in a non-integer number of coaxial elements per turn. In accordance with at least one embodiment, variation of the lengths of coaxial elements of a helical array may be used to implement a broadband antenna.

In accordance with at least one embodiment, a multiband antenna may be implemented by concentrically arranging a first helix of a smaller diameter inside a second helix of a larger diameter, with one or more additional helices of different diameters arranged concentrically if additional bands are desired. The helices may be wound the same direction (i.e., right hand twist or left hand twist) or may be wound in opposite directions. The multiple band helices may be feed from the same feed line, or at least one separate feed line may be provided to feed one or more different helices.

In accordance with at least one embodiment, a balun element may be implemented as a sleeve balun, which may, for example, be implemented as a quarter wave conductive sleeve placed over but isolated from the shield of the coaxial feed line feeding the first coaxial radiating element (i.e., the coaxial radiating element most proximal to the balun and feed point) except at the end of the coaxial feed line, where the coaxial feed line is coupled to the first coaxial radiating element. At the end of the coaxial feed line feeding the first coaxial radiating element, the conductive sleeve is electrically connected to the shield of the coaxial feed line, in accordance with at least one embodiment. As another example, in accordance with at least one embodiment, a balun element may be implemented as a current balun. As yet another example, in accordance with at least one embodiment, a balun element may be implemented as a half wavelength coaxial cable balun.

In accordance with at least one embodiment, the last coaxial radiating element (i.e., the coaxial radiating element most distal from the feed point) is coupled to a terminal element. In accordance with at least one embodiment, the terminal element is a radiating element. In accordance with at least one embodiment, the terminal element is a quarter wave element. In accordance with at least one embodiment, the terminal element is a wire. In accordance with at least one embodiment, the terminal element is continuation of the center conductor of the last coaxial radiating element beyond the distal end of the last coaxial radiating element. In accordance with at least one embodiment, the terminal element is a conductive tube. In accordance with at least one embodiment, the terminal element is a coaxial transmission line segment. In accordance with at least one embodiment, when the terminal element is a coaxial transmission line segment, its center conductor remains unconnected and only its shield is used a conductor, being electrically connected to the center conductor of the last coaxial radiating element. In the case that a terminal element is coaxial transmission line segment, even if it is a radiating element, it is not considered to be a coaxial radiating element, as that term is used herein, as it does not function as a coaxial transmission line in its role as a terminal element. In accordance with at least one embodiment, the terminal element is electrically coupled to the distal end of the center conductor of the last coaxial radiating element. In accordance with at least one embodiment, the terminal element is not electrically connected to the shield conductor of the last coaxial radiating element. In accordance with at least one embodiment, if the terminal element is a quarter wave radiating element it implements an approximately 50 ohm termination impedance at the distal end of the succession of coaxial radiating elements while also radiating power applied to it through the succession of coaxial radiating elements and receiving and conveying through the succession of coaxial radiating elements signals impinging upon it. The action of the terminal element can be viewed as a cause for unbalance to currents flowing on the coaxial transmission line elements, thereby causing current to flow on the outer shield conductors which causes these elements to radiate (or reciprocally receive radiated signals).

In accordance with at least one embodiment, elements having lengths that are odd integer multiples of their engineered lengths may be used. As an example, an element half a wavelength long may be implemented as an element half a wavelength long, one and half wavelengths long, two and a half wavelengths long, three and a half wavelengths long, etc. As another example, an element a quarter wavelength long may be implemented as an element a quarter wavelength long, three quarters of a wavelength long, one and a quarter wavelengths long, one and three quarters wavelengths long, two and a quarter wavelengths long, two and three quarters wavelengths long, etc. In accordance with at least one embodiment, elements having engineered lengths of 1/m wavelength may be implemented as m·n+1 multiples of their engineered lengths, where n is a positive integer. As an example, elements having engineered lengths of a half wavelength may be implemented as a half wavelength long, one and a half wavelengths long, two and half wavelengths long, three and a half wavelengths long, etc. As another example, elements having engineered lengths of a quarter wavelength may be implemented as a quarter wavelength long, one and a quarter wavelengths long, two and a quarter wavelengths long, three and a quarter wavelengths long, etc.

Antenna Element Feed Relationships

FIG. 1 is a diagram illustrating an uncoiled coaxial collinear structure that does not provide horizontal polarization omnidirectionally. Such an antenna comprises at least one element that is nominally λ/2 (or an odd multiple of λ/2) in electrical length, an end element that is nominally λ/4 (or an odd multiple of λ/4) in electrical length, and a balun. The example illustrated in FIG. 1 comprises feed point 101, coaxial transmission line 102, ferrite choke balun 103, balun element 104, array 105, and terminal element 109. Balun element 104 is a conductive sleeve balun. Array 105 comprises coaxial radiating elements 106, 107, and 108. A transmitter or receiver is coupled to feed point 101, which is at a proximal end of coaxial transmission line 102. Ferrite choke balun 103 surrounds a first portion of coaxial transmission line 102. Conductive sleeve balun 104 surrounds a second portion of coaxial transmission line 102 at a distal end of coaxial transmission line 102. Conductive sleeve balun 104 is insulated from the conductors of coaxial transmission line 102 except at a distal end of conductive sleeve balun 104, at junction 110, where it is electrically coupled to a shield conductor of coaxial transmission line 102 and where the shield conductor of coaxial transmission line 102 is also coupled to a center conductor of coaxial radiating element 106 at a proximal end of coaxial radiating element 106. A center conductor of coaxial transmission line 102 is coupled to a shield conductor of coaxial radiating element 106 at junction 110. At a distal end of coaxial radiating element 106 and a proximal end of coaxial radiating element 107 is junction 111. A center conductor of coaxial radiating element 106 is coupled to a shield conductor of coaxial radiating element 107 at junction 111. A shield conductor of coaxial radiating element 106 is coupled to a center conductor of coaxial radiating element 107 at junction 111. At a distal end of coaxial radiating element 107 and a proximal end of coaxial radiating element 108 is junction 112. A center conductor of coaxial radiating element 107 is coupled to a shield conductor of coaxial radiating element 108 at junction 112. A shield conductor of coaxial radiating element 107 is coupled to a center conductor of coaxial radiating element 108 at junction 112. At a distal end of coaxial radiating element 108 and a proximal end of terminal element 109 is junction 113. A center conductor of coaxial radiating element 108 is coupled to terminal element 109 at junction 113. A shield conductor of coaxial radiating element 108 need not be connected at junction 113.

In further reference to FIG. 1, each λ/2 element is end fed by the previous λ/2 element, with the first λ/2 element fed by the balun and the last λ/2 feeding the λ/4 end element. Current on the shield of each coaxial element produces the desired radiation. Elements of λ/2 (or an odd multiple of λ/2) in electrical length provide a delay of 180° in order to properly feed the next element in the array. To achieve an electrical length of λ/2 in the coaxial cable medium, the physical length of each λ/2 element should be proportioned by the velocity of propagation through the coaxial cable medium. If the λ/2 elements are wrapped around a vertical axis into a helix with three elements per turn, the resulting structure can be expected to approximate the radiation pattern of an array of stacked wheel structures but without the feed point complexity of an array of stacked wheel structures.

Figure 2:
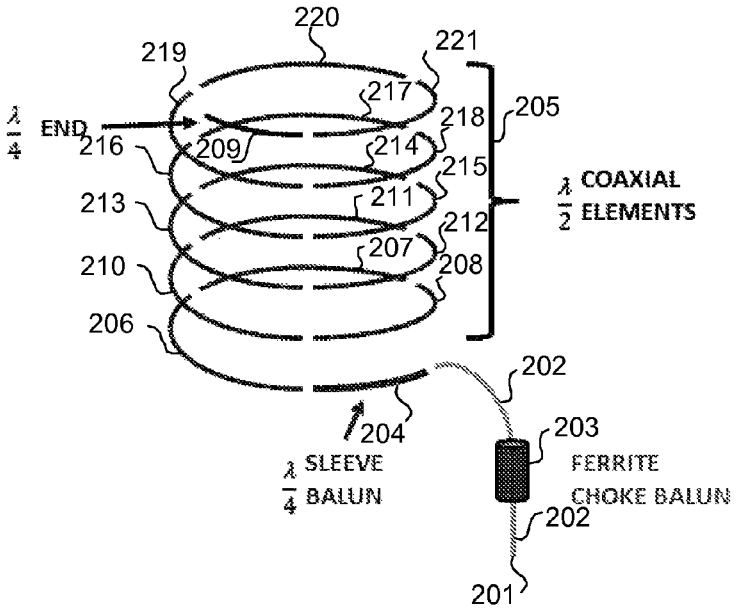
FIG. 2 illustrates a helical collinear structure in accordance with at least one embodiment.

FIG. 2 illustrates a helical collinear structure in accordance with at least one embodiment. The helical collinear structure comprises feed point 201, coaxial transmission line 202, ferrite choke balun 203, conductive sleeve balun 204, array 205, and terminal element 209. Array 205 comprises coaxial radiating elements 206, 207, 208, 210, 211, 212, 213, 214, 215, 216, 217, 218, 219, 220, and 221. Feed point 201 is at a proximal end of coaxial transmission line 202. Ferrite choke balun 203 surrounds coaxial transmission line 202. Conductive sleeve balun 204 surrounds, but is insulated from, a distal portion of coaxial transmission line 202, except at a distal end of coaxial transmission line 202, where a distal end of conductive sleeve balun 204 is coupled to a shield conductor of coaxial transmission line 202, where the shield conductor of coaxial transmission line 202 is also coupled to a center conductor of coaxial radiating element 204 at a proximal end of coaxial radiating element 204, and where a center conductor of coaxial transmission line 202 is coupled to a shield conductor of coaxial radiating element 204. At a distal end of coaxial radiating element 204 and a proximal end of coaxial radiating element 206, a center conductor of coaxial radiating element 204 is coupled to a shield conductor of coaxial radiating element 206, and a shield conductor of coaxial radiating element 204 is coupled to a center conductor of coaxial radiating element 206. At a distal end of coaxial radiating element 206 and a proximal end of coaxial radiating element 207, a center conductor of coaxial radiating element 206 is coupled to a shield conductor of coaxial radiating element 207, and a shield conductor of coaxial radiating element 206 is coupled to a center conductor of coaxial radiating element 207. At a distal end of coaxial radiating element 207 and a proximal end of coaxial radiating element 208, a center conductor of coaxial radiating element 207 is coupled to a shield conductor of coaxial radiating element 208, and a shield conductor of coaxial radiating element 207 is coupled to a center conductor of coaxial radiating element 208. At a distal end of coaxial radiating element 208 and a proximal end of coaxial radiating element 210, a center conductor of coaxial radiating element 208 is coupled to a shield conductor of coaxial radiating element 210, and a shield conductor of coaxial radiating element 208 is coupled to a center conductor of coaxial radiating element 210. At a distal end of coaxial radiating element 210 and a proximal end of coaxial radiating element 211, a center conductor of coaxial radiating element 210 is coupled to a shield conductor of coaxial radiating element 211, and a shield conductor of coaxial radiating element 210 is coupled to a center conductor of coaxial radiating element 211. At a distal end of coaxial radiating element 211 and a proximal end of coaxial radiating element 212, a center conductor of coaxial radiating element 211 is coupled to a shield conductor of coaxial radiating element 212, and a shield conductor of coaxial radiating element 211 is coupled to a center conductor of coaxial radiating element 212. At a distal end of coaxial radiating element 212 and a proximal end of coaxial radiating element 213, a center conductor of coaxial radiating element 212 is coupled to a shield conductor of coaxial radiating element 213, and a shield conductor of coaxial radiating element 212 is coupled to a center conductor of coaxial radiating element 213. At a distal end of coaxial radiating element 213 and a proximal end of coaxial radiating element 214, a center conductor of coaxial radiating element 213 is coupled to a shield conductor of coaxial radiating element 214, and a shield conductor of coaxial radiating element 213 is coupled to a center conductor of coaxial radiating element 214. At a distal end of coaxial radiating element 214 and a proximal end of coaxial radiating element 215, a center conductor of coaxial radiating element 214 is coupled to a shield conductor of coaxial radiating element 215, and a shield conductor of coaxial radiating element 214 is coupled to a center conductor of coaxial radiating element 215. At a distal end of coaxial radiating element 215 and a proximal end of coaxial radiating element 216, a center conductor of coaxial radiating element 215 is coupled to a shield conductor of coaxial radiating element 216, and a shield conductor of coaxial radiating element 215 is coupled to a center conductor of coaxial radiating element 216. At a distal end of coaxial radiating element 216 and a proximal end of coaxial radiating element 217, a center conductor of coaxial radiating element 216 is coupled to a shield conductor of coaxial radiating element 217, and a shield conductor of coaxial radiating element 216 is coupled to a center conductor of coaxial radiating element 217. At a distal end of coaxial radiating element 217 and a proximal end of coaxial radiating element 218, a center conductor of coaxial radiating element 217 is coupled to a shield conductor of coaxial radiating element 218, and a shield conductor of coaxial radiating element 217 is coupled to a center conductor of coaxial radiating element 218. At a distal end of coaxial radiating element 218 and a proximal end of coaxial radiating element 219, a center conductor of coaxial radiating element 218 is coupled to a shield conductor of coaxial radiating element 219, and a shield conductor of coaxial radiating element 218 is coupled to a center conductor of coaxial radiating element 219. At a distal end of coaxial radiating element 219 and a proximal end of coaxial radiating element 220, a center conductor of coaxial radiating element 219 is coupled to a shield conductor of coaxial radiating element 220, and a shield conductor of coaxial radiating element 219 is coupled to a center conductor of coaxial radiating element 220. At a distal end of coaxial radiating element 220 and a proximal end of coaxial radiating element 221, a center conductor of coaxial radiating element 220 is coupled to a shield conductor of coaxial radiating element 221, and a shield conductor of coaxial radiating element 220 is coupled to a center conductor of coaxial radiating element 221. At a distal end of coaxial radiating element 221 and a proximal end of terminal element 209, a center conductor of coaxial radiating element 221 is coupled to a conductor of terminal element 209. A shield conductor of coaxial radiating element 221 may remain unconnected at the distal end of coaxial radiating element 221. Array 205 is arranged as a helical array, wherein the coaxial radiating elements of array 205 are arranged along a helix.

An antenna in accordance with such a structure allows many elements to be fed simply from a common point. The pitch (i.e., spacing between turns) can be varied to achieve desirable antenna characteristics. Finer (i.e., lesser) pitch maintains horizontal polarization "purity," while coarser (i.e., greater) pitch provides increased gain. In accordance with at least one embodiment, the pitch is so coarse as to allow only a single loop of the antenna elements about the vertical axis of the antenna. In accordance with at least one embodiment, the pitch is so fine as to maintain consecutive loops within $\lambda/8$ of each other. In accordance with at least one embodiment, good gain in the horizontal mode is provided when pitch approximates $\lambda/2$. For example, in accordance with at least one embodiment, the pitch is between $\lambda/4$ and $3\lambda/4$. As another example, in accordance with at least one embodiment, the pitch is between $\lambda/4$ and $\lambda/2$. As yet another example, in accordance with at least one embodiment, the pitch is between $0.3\lambda$ and $\lambda/2$. As further example, in accordance with at least one embodiment, the pitch is between $0.33\lambda$ and $0.45\lambda$. As another example, in accordance with at least one embodiment, the pitch is between $0.375\lambda$ and $\lambda/2$. As a further example, in accordance with at least one embodiment, the pitch is between $0.38\lambda$ and $0.4\lambda$.

Simulation

Figure 3:
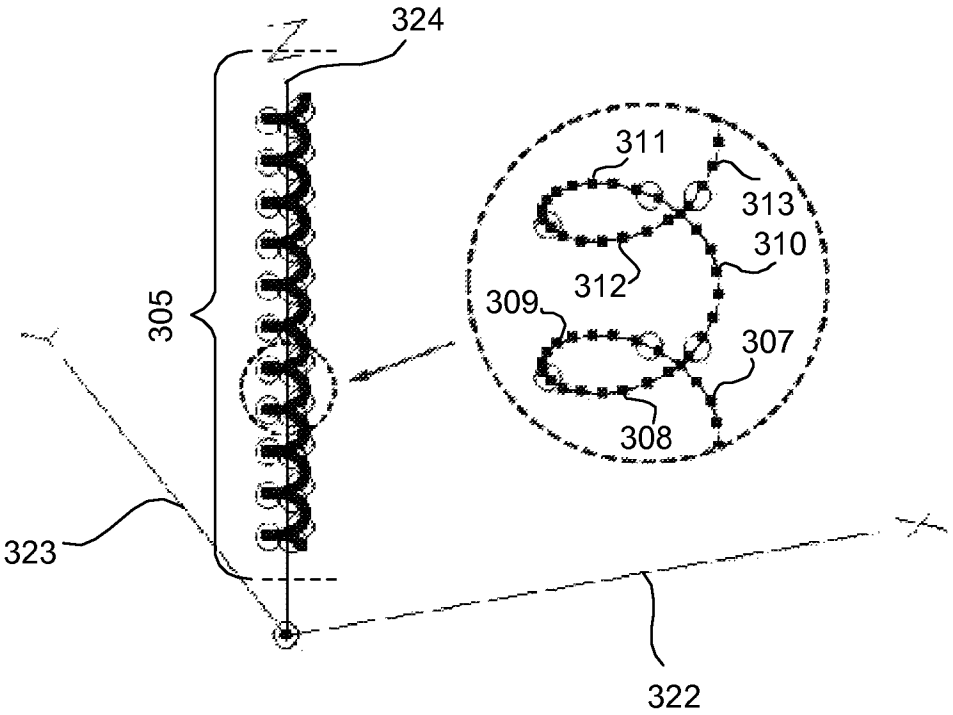
FIG. 3 is a diagram illustrating a model of an embodiment comprising 11 turns with a pitch of 0.38λ.

EZNEC software, available from developer Roy Lewallen, W7EL, at www.eznec.com, was used to simulate the performance of the helical collinear. FIG. 3 is a diagram illustrating a model of an embodiment comprising 11 turns with a pitch of $0.38\lambda$. The model comprises a helical array 305 surrounding its axis 324. Helical array 305 comprises elements 307, 309, 308, 310, 311, 312, and 313 arranged successively along a helix. The axis of the helix along which helical array 305 is arranged is Z axis 324. X axis 322 and Y axis 323 are orthogonal to Z axis 324 and to each other. Table 1 provides specifications for such an exemplary embodiment.

TABLE 1

Helical Collinear Calculations for an Exemplary 902 MHz Antenna

| | (inches) | (mm) | | | |
|---|---|---|---|---|---|
| Length of λ/2 | 4.60 | 116 | (0.35 λ) | Elements/Turn | 3 |
| Diameter | 4.10 | 104 | (0.31 λ) | Turns | 11 |
| Pitch | 4.95 | 126 | (0.38 λ) | Total Segments | 264 |
| Linear Total | 153.78 | 3906 | (11.65 λ) | N of λ/2 | 32 |
| Helix Length | 54.48 | 1384 | (4.13 λ) | Segments/Turn | 24 |
| Bottom | 5.91 | 150 | | | |
| Top | 60.39 | 1534 | | | |

Figure 4:
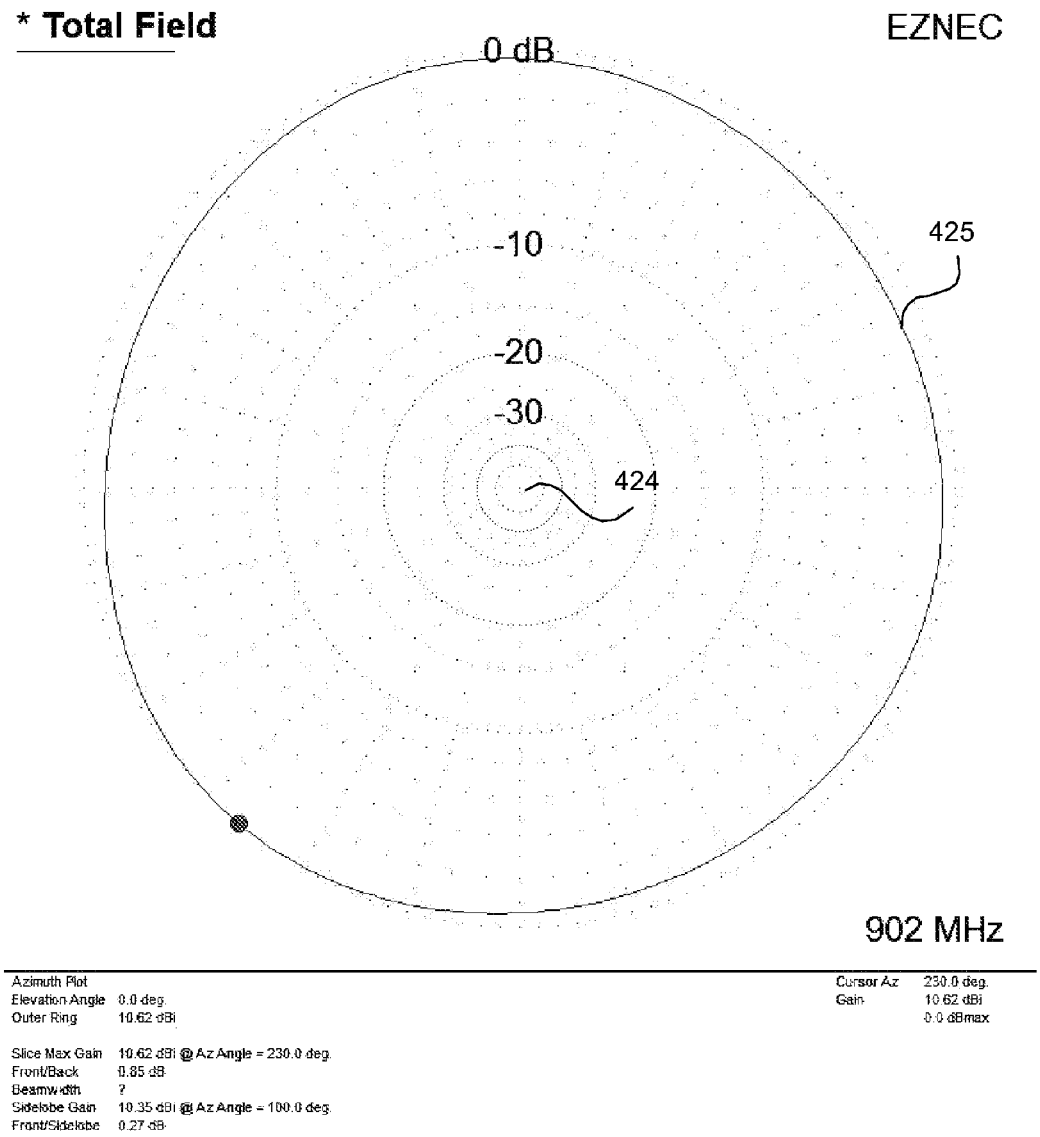
FIG. 4 is a plot illustrating azimuth simulation results in accordance with the embodiment of FIG. 3.
Figure 5:
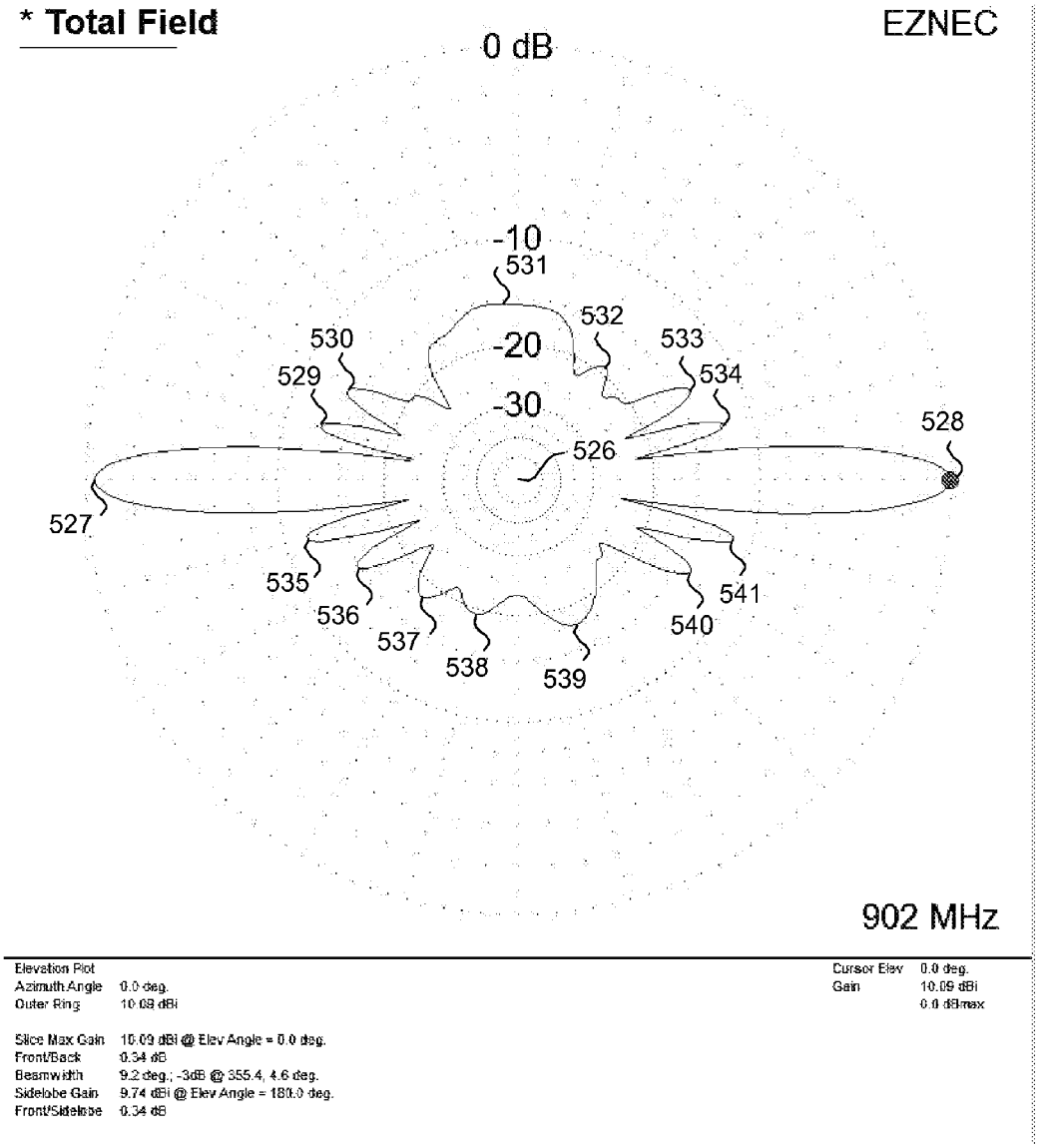
FIG. 5 is a plot illustrating elevation simulation results in accordance with the embodiment of FIG. 3.

With these preliminary calculations, a helical model with periodic current sources can be constructed. The current magnitudes can also be tapered to allow for attenuation along the coaxial cable segments. FIG. 4 is a plot illustrating azimuth simulation results in accordance with the embodiment of FIG. 3. The plot shows an omnidirectional pattern 425 centered around an axis 424. FIG. 5 is a plot illustrating elevation simulation results in accordance with the embodiment of FIG. 3. The plot shows the main lobes 527 and 528 of the omnidirectional pattern, centered about point 526, which lies along an axis of symmetry of the pattern, as well as side lobes 529, 530, 531, 532, 533, 534, 535 above the main lobes 527 and 528 and side lobes 535, 536, 537, 538, 539, 540, and 541 below main lobes 527 and 528. A good omnidirectional pattern is achieved with +10.6 dBi (decibels relative to an isotropic pattern) gain. This is a bit more than +8 dB over a dipole antenna. The azimuth pattern has approximately ±0.4 dB ripple. A larger pitch will reduce this; but, also increase the vertical polarization content.

Figure 6:
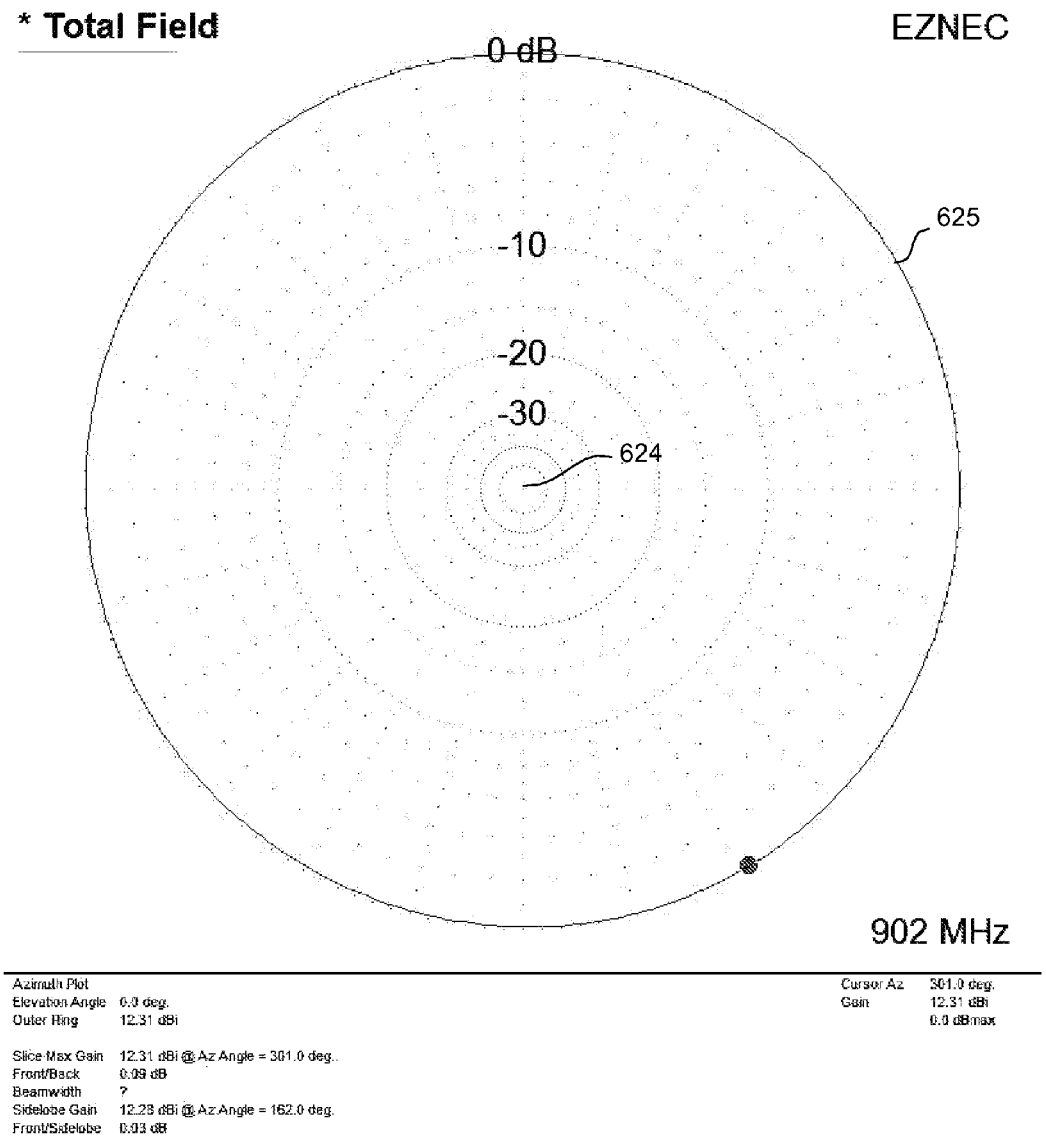
FIG. 6 is a plot illustrating azimuth simulation results in accordance with an embodiment comprising 22 turns.
Figure 7:
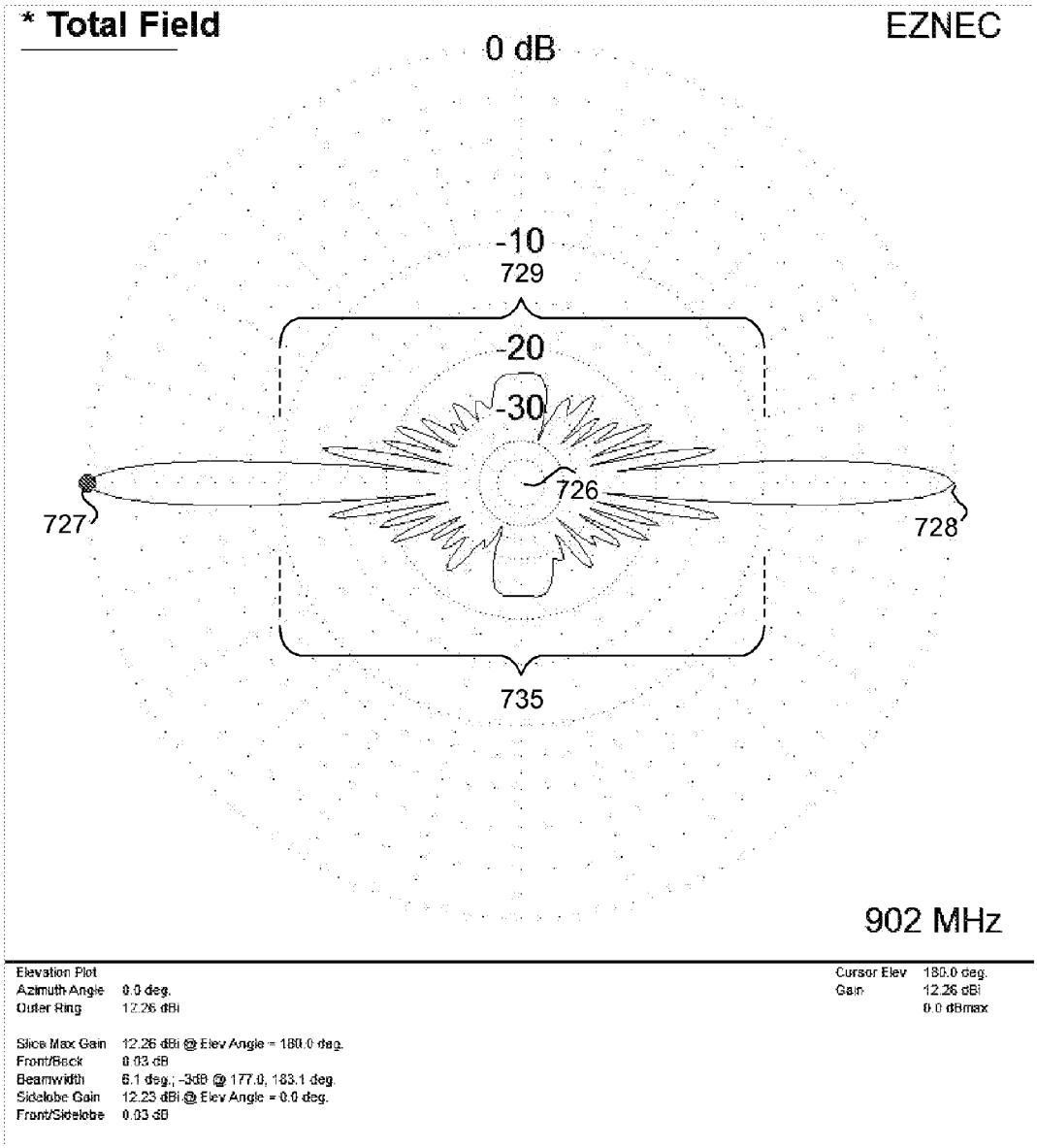
FIG. 7 is a plot illustrating elevation simulation results in accordance with an embodiment comprising 22 turns.
Figure 8:
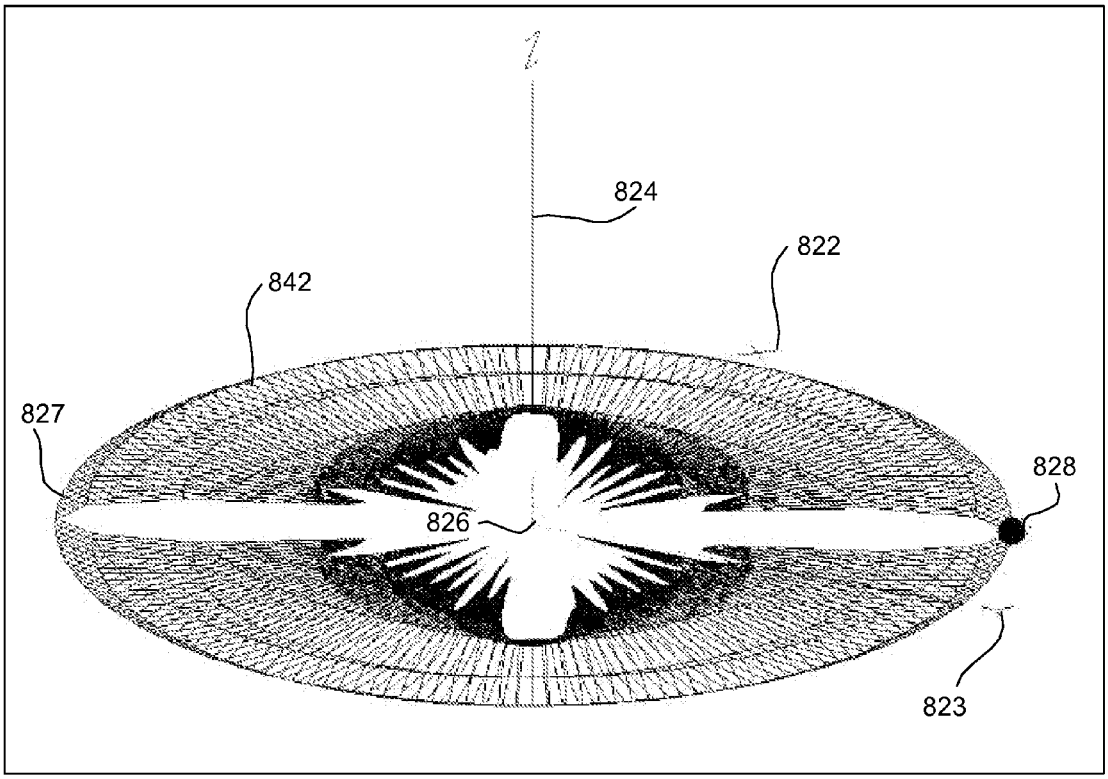
FIG. 8 is a three-dimensional plot illustrating EZNEC simulation results in accordance with an embodiment of a helical collinear antenna comprising 22 turns having a pitch of λ/2.

FIG. 6 is a plot illustrating azimuth simulation results in accordance with an embodiment comprising 22 turns. The plot shows an omnidirectional pattern 625 centered around an axis 624. FIG. 7 is a plot illustrating elevation simulation results in accordance with an embodiment comprising 22 turns. The plot shows main lobes 727 and 728 centered about point 726, which lies along an axis of symmetry of the pattern. The plot also shows side lobes 729 above the main lobes 727 and 728 and side lobes 735 below the main lobes 727 and 728. FIG. 8 is a three-dimensional plot illustrating EZNEC simulation results in accordance with an embodiment of a helical collinear antenna comprising 22 turns having a pitch of λ/2. The plot comprises an omnidirectional pattern 842 centered about a point 826, which lies on axis of symmetry 824, about which the omnidirectional pattern 842 is circularly symmetric. Omnidirectional pattern 842 comprises main lobes 827 and 828, which lie in an X-Y plane defined by X axis 822 and Y axis 823, which are orthogonal to each other and to Z axis 824. Table 2 provides the port definition used to model the exemplary 22 turn structure using the EZNEC analysis software.

TABLE 2

902 MHz EZNEC Port Definition

| Element | | Linear (inches) | Linear (mm) | Z-coordinate (mm) | Segments | Bottom Segment |
|---|---|---|---|---|---|---|
| 1 | λ/4 | 150.48 | 3822 | 1504 | 4 | 260 |
| 2 | λ/2 | 145.88 | 3705 | 1462 | 8 | 252 |
| 3 | λ/2 | 141.28 | 3588 | 1421 | 8 | 244 |
| 4 | λ/2 | 136.68 | 3471 | 1379 | 8 | 236 |
| 5 | λ/2 | 132.08 | 3354 | 1338 | 8 | 228 |
| 6 | λ/2 | 127.48 | 3237 | 1297 | 8 | 220 |
| 7 | λ/2 | 122.88 | 3121 | 1255 | 8 | 212 |
| 8 | λ/2 | 118.28 | 3004 | 1214 | 8 | 204 |
| 9 | λ/2 | 113.68 | 2887 | 1173 | 8 | 196 |
| 10 | λ/2 | 109.08 | 2770 | 1131 | 8 | 188 |
| 11 | λ/2 | 104.48 | 2653 | 1090 | 8 | 180 |
| 12 | λ/2 | 99.88 | 2536 | 1048 | 8 | 172 |
| 13 | λ/2 | 95.28 | 2420 | 1007 | 8 | 164 |
| 14 | λ/2 | 90.68 | 2303 | 966 | 8 | 156 |
| 15 | λ/2 | 86.08 | 2186 | 924 | 8 | 148 |
| 16 | λ/2 | 81.48 | 2069 | 883 | 8 | 140 |
| 17 | λ/2 | 76.88 | 1952 | 841 | 8 | 132 |
| 18 | λ/2 | 72.28 | 1835 | 800 | 8 | 124 |
| 19 | λ/2 | 67.68 | 1719 | 759 | 8 | 116 |
| 20 | λ/2 | 63.08 | 1602 | 717 | 8 | 108 |
| 21 | λ/2 | 58.48 | 1485 | 676 | 8 | 100 |
| 22 | λ/2 | 53.88 | 1368 | 634 | 8 | 92 |
| 23 | λ/2 | 49.28 | 1251 | 593 | 8 | 84 |
| 24 | λ/2 | 44.68 | 1134 | 552 | 8 | 76 |
| 25 | λ/2 | 40.08 | 1017 | 510 | 8 | 68 |
| 26 | λ/2 | 35.48 | 901 | 469 | 8 | 60 |
| 27 | λ/2 | 30.88 | 784 | 427 | 8 | 52 |
| 28 | λ/2 | 26.28 | 667 | 386 | 8 | 44 |
| 29 | λ/2 | 21.68 | 550 | 345 | 8 | 36 |
| 30 | λ/2 | 17.08 | 433 | 303 | 8 | 28 |
| 31 | λ/2 | 12.48 | 316 | 262 | 8 | 20 |
| 32 | λ/2 | 7.88 | 200 | 220 | 8 | 12 |
| 33 | λ/2 | 3.28 | 83 | 179 | 8 | 4 |
| 34 | λ/4 | 0.00 | 0 | 150 | 4 | 0 |

The pitch for such simulation is approximately λ/2. Such an exemplary 22 turn structure is calculated to yield +12.2 dBi (decibels relative to an isotropic pattern) gain, which is +10 dBd (decibels relative to a dipole) gain.

Sensitivity

Figure 15:
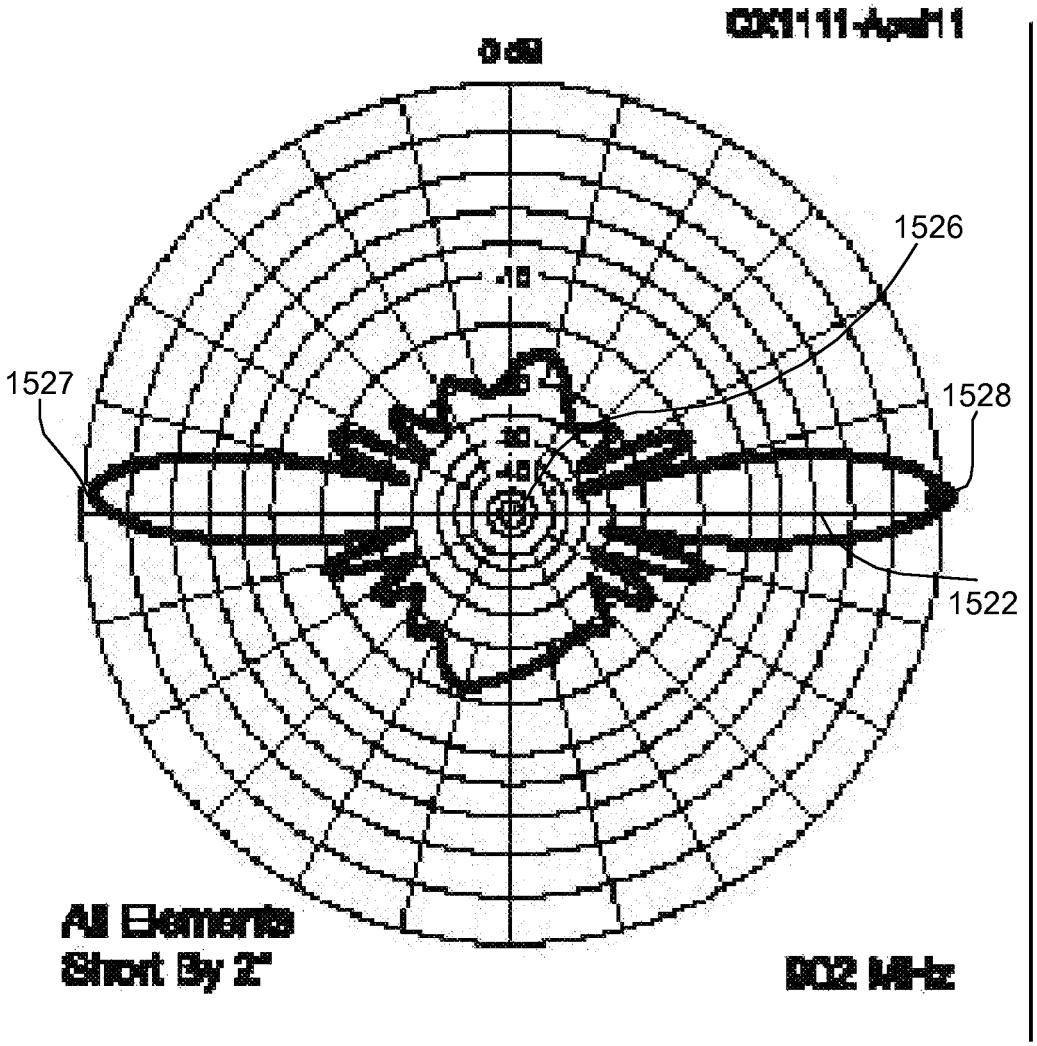
FIG. 15 is an EZNEC simulation plot for an exemplary 11 turn 0.38λ pitch helix illustrating a net up tilt in the main lobe of approximately 2° resulting from all elements being 2° of phase shorter than ideal.
Figure 16:
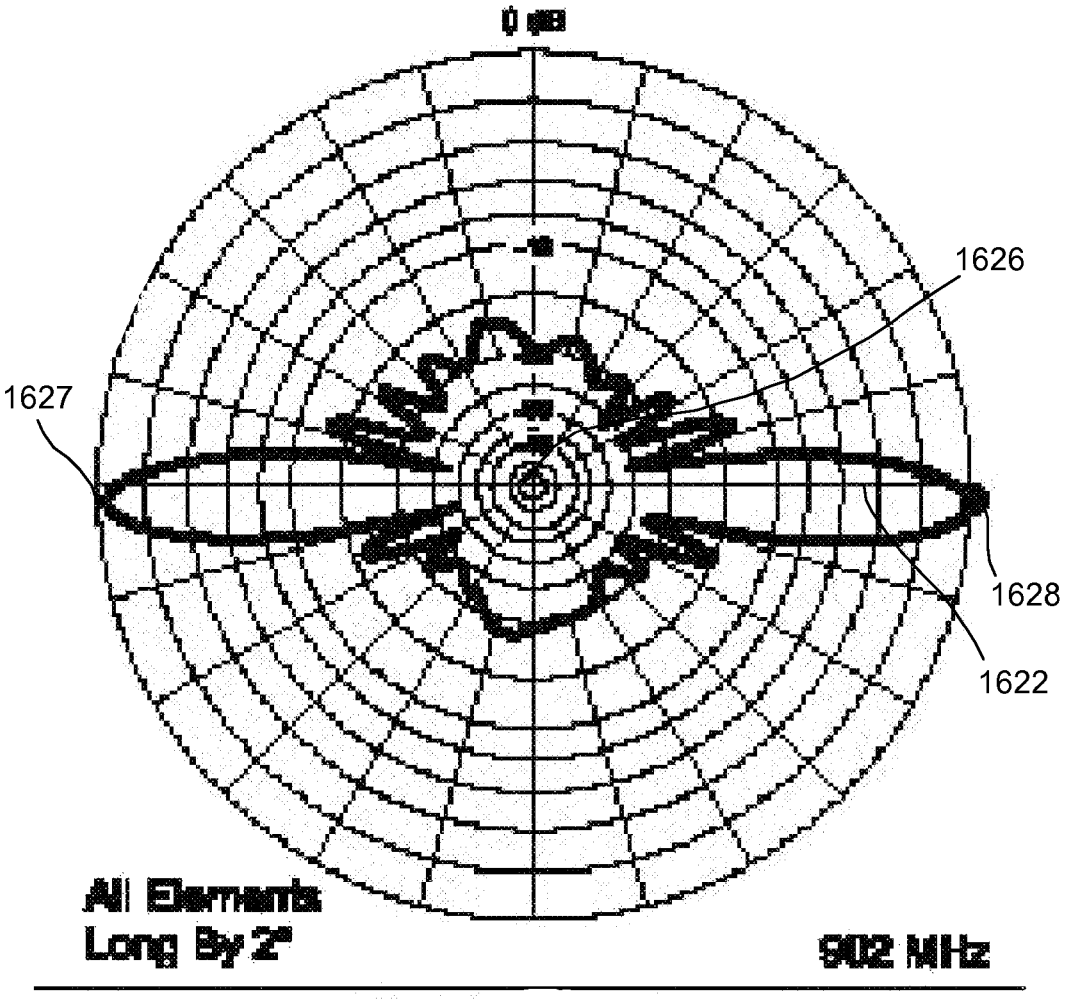
FIG. 16 is an EZNEC simulation plot for an exemplary 11 turn 0.38λ pitch helix illustrating a net down tilt in the main lobe of approximately 2° resulting from all elements being 2° of phase longer than ideal.
Figure 17:
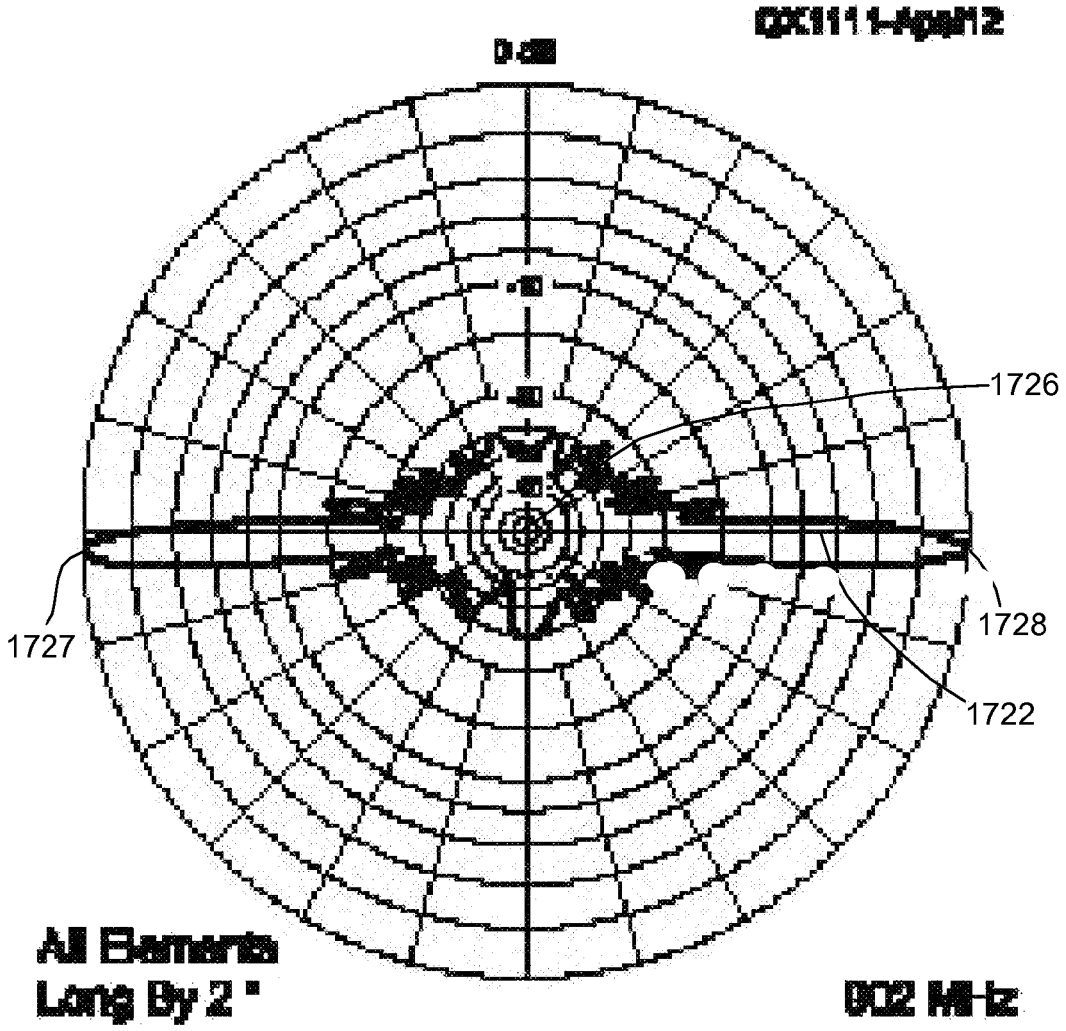
FIG. 17 is an EZNEC simulation plot for an exemplary 22 turn 0.5λ pitch helix illustrating a net down tilt in the main lobe resulting from each of the elements being 2° of phase shorter than ideal.
Figure 18:
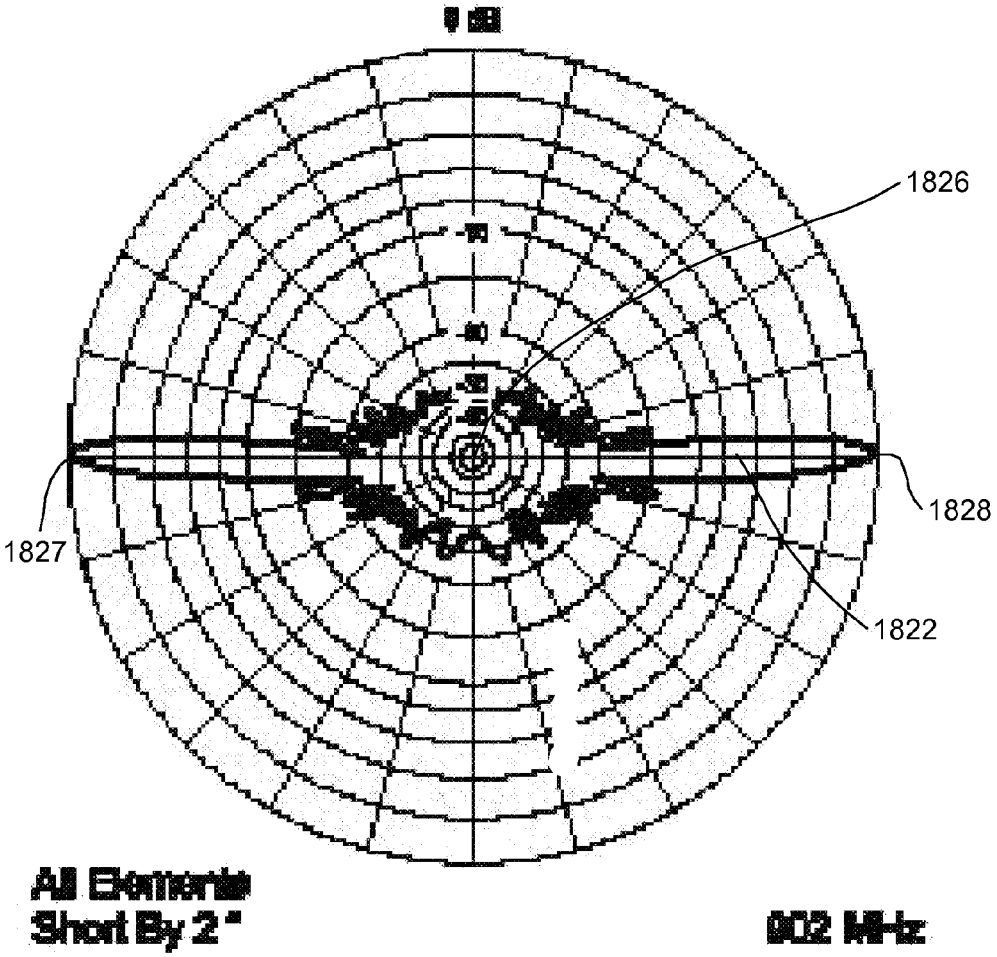
FIG. 18 is an EZNEC simulation plot for an exemplary 22 turn 0.5λ pitch helix illustrating a net up tilt in the main lobe resulting from each of the elements being 2° longer than ideal.

The practical matter of errors in the length of elements should be considered. With half wave dimensions of 4.6" in RG-316 coaxial cable, a 2° (i.e., two degrees of phase) error in the element length is introduced by an element length error of 50 mils (i.e., thousandths of an inch). Careful measurement with a caliper can keep element length errors within an acceptable tolerance. The worst cases would be if all elements were too short or all were too long. The combined effect of such individual errors would propagate a cumulative error throughout the array. FIG. 15 is an EZNEC simulation plot for an exemplary 11 turn 0.38λ pitch helix illustrating a net up tilt in the main lobe of approximately 2° resulting from all elements being 2° of phase shorter than ideal. FIG. 16 is an EZNEC simulation plot for an exemplary 11 turn 0.38λ pitch helix illustrating a net down tilt in the main lobe of approximately 2° resulting from all elements being 2° of phase longer than ideal. FIG. 17 is an EZNEC simulation plot for an exemplary 22 turn 0.5λ pitch helix illustrating a net down tilt in the main lobe resulting from each of the elements being 2° of phase shorter than ideal. FIG. 18 is an EZNEC simulation plot for an exemplary 22 turn 0.5λ pitch helix illustrating a net up tilt in the main lobe resulting from each of the elements being 2° longer than ideal. Practical fabrication techniques might yield elements constructed to the correct length in the mean, with some distribution in length errors (with some elements shorter than ideal and other elements longer than ideal). Such a distribution of length errors will spread the main lobe for some net loss in gain rather than a net tilt up or net down tilt.

FIG. 15 is an EZNEC simulation plot for an exemplary 11 turn 0.38λ pitch helix illustrating a net up tilt in the main lobe of approximately 2° resulting from all elements being 2° of phase shorter than ideal. The plot shows main lobes 1527 and 1528 approximately centered about center 1526. However, main lobes 1527 and 1528 are not centered on X axis 1522 but rather are both tilted upward relative to X axis 1522.

FIG. 16 is an EZNEC simulation plot for an exemplary 11 turn 0.38λ pitch helix illustrating a net down tilt in the main lobe of approximately 2° resulting from all elements being 2° of phase longer than ideal. The plot shows main lobes 1627 and 1628 approximately centered about center 1626. However, main lobes 1627 and 1628 are not centered on X axis 1622 but rather are both tilted downward relative to X axis 1622.

FIG. 17 is an EZNEC simulation plot for an exemplary 22 turn 0.5λ pitch helix illustrating a net down tilt in the main lobe resulting from each of the elements being 2° of phase shorter than ideal. The plot shows main lobes 1727 and 1728 approximately centered about center 1726. However, main lobes 1727 and 1728 are not centered on X axis 1722 but rather are both tilted downward relative to X axis 1722.

FIG. 18 is an EZNEC simulation plot for an exemplary 22 turn 0.5λ pitch helix illustrating a net up tilt in the main lobe resulting from each of the elements being 2° longer than ideal. The plot shows main lobes 1827 and 1828 approximately centered about center 1826. However, main lobes 1827 and 1828 are not centered on X axis 1822 but rather are both tilted upward relative to X axis 1822.

Design Considerations

In accordance with at least one embodiment, each turn comprises at least three λ/2 elements. Thus, the circumference of each turn is at least 3/2λ. At least one embodiment provides four λ/2 elements per turn. Such an embodiment provides opposing elements that are anti-phased with separation near λ/2, thereby providing good gain. At least one embodiment provides three λ/2 elements per turn, with each element spanning 120 degrees of arc.

An important design parameter is pitch. Pitch is the distance, in a direction parallel to the axis of the helix, between the beginning and end of each turn in the helix. The smaller (i.e., finer) the pitch, the more the turns provide performance approximating "big wheel" structures having stacking distances proportional to the pitch. Accordingly, with finer pitches, horizontal polarization dominates and gain is lower. Larger (i.e., coarser) pitches provide higher gain, but with polarization angle no longer horizontal. In accordance with at least one embodiment is a nearly vertical collinear when pitch approaches 1.5λ. This yields very good gain with vertical polarization. In accordance with at least one embodiment, the stacking distance without grating lobes is λ/2.

Figure 9:
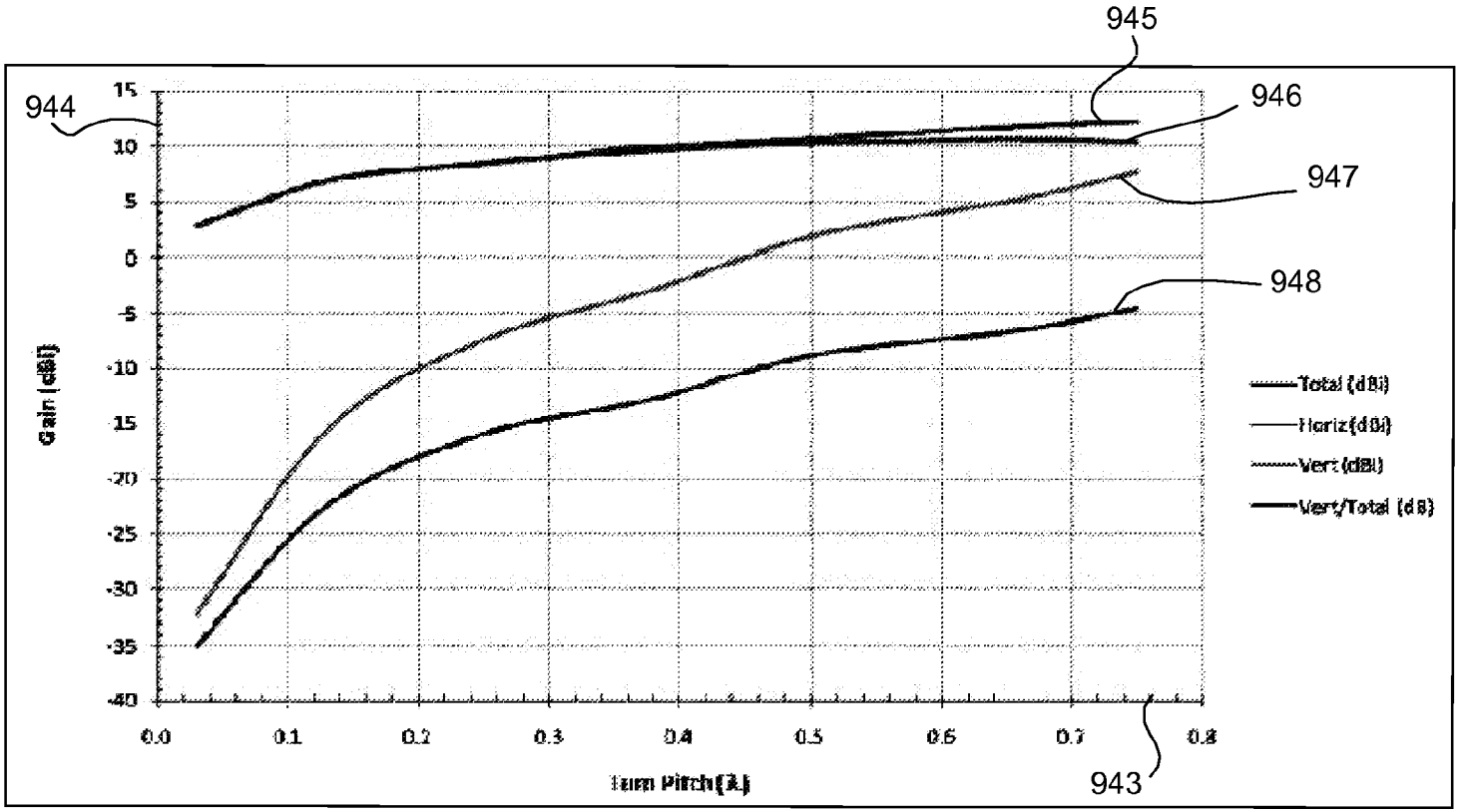
FIG. 9 is a plot illustrating how pitch trades-off the fraction of radiated energy in the horizontal polarization in accordance with an 11 turn helix.

FIG. 9 is a plot illustrating how pitch trades-off the fraction of radiated energy in the horizontal polarization in accordance with an exemplary 11 turn helix. The plot has an X axis 943 representing the pitch of the turns of the helix denominated in wavelength (λ). The plot has a Y axis 944 representing gain denominated in dBi. The plot shows total gain 945 of about 6 dBi at 0.1λ increasing to about 8 dBi at 0.2λ, further increasing to about 9 dBi at 0.3λ, increasing to about 10 dBi around 0.4λ to 0.5λ, increasing to about 11 dBi at 0.6λ, and increasing to about 12 dBi at 0.7λ. The plot shows horizontally polarized gain 945 for the horizontally polarized component of similar values to the total gain 945 below about 0.5λ, after which the horizontally polarized gain 945 remains approximately constant at about 10 dBi from 0.5λ to 0.7λ and beyond. The plot shows vertically polarized gain 947 rising from about −20 dBi at 0.1λ to about −10 dBi at 0.2λ to about −5 dBi at 0.3λ to about −2 dBi at 0.4λ. By 0.5λ of pitch of the helix, vertically polarized gain 947 has risen above 0 dBi to about 0.2 dBi, then to about 4 dBi at 0.6λ, then to about 6 dBi at 0.7λ. The plot shows vertical polarized gain divided by total gain 948 increasing from about −26 dB at 0.1λ to about −18 dB at 0.2λ to about −15 dB at 0.3λ to about −12 dB at 0.4λ to about −9 dB at 0.5λ to about −7 dB at about 0.6λ to about −6 at 0.7λ. These analysis results are qualitatively representative of other cases with differing number of turns. Several observations can be made. Firstly, in accordance with at least one embodiment, while total gain continues to increase with pitch, in accordance with at least one embodiment, optimal gain in the horizontal polarization is achieved with pitch ≥0.38λ. Secondly, in accordance with at least one embodiment, vertically polarized radiation is −13 dB relative to total radiation at pitch of 0.38λ. Vertically polarized radiation degrades to −8 dB relative to total radiation as the pitch is increased to λ/2, in accordance with at least one embodiment. Based on the above observations, in accordance with at least one embodiment that emphasizes horizontally polarized radiation, the optimum pitch is between 0.38λ and 0.4λ, inclusive.

In accordance with at least one embodiment, driving point impedance depends on the number of elements. As the number of elements is increased, the impedance decreases. Prototypes built for 902 MHz and 1296 MHz with 11 turns and 15 turns, respectively, have yielded good VSWR to 50Ω. On the other hand, a single turn helical array (plus λ/4 end section) built with RG-8 coaxial cables for 6 meters (i.e., 50 MHz) utilized a 4:1 transformer to achieve good VSWR.

Construction

In accordance with at least one embodiment, a PVC (polyvinyl chloride) radome can be used to enclose high frequency realizations of this antenna. For 902 MHz, 4" tubing works well. At 1296 MHz, a 3" PVC pipe yields good results. The coaxial elements are radiating due to currents on the shield. Since they are each cut, in accordance with at least one embodiment, to λ/2 in the coaxial cable medium, each will be less than λ/2 as a radiating element in free space. The dielectric loading effect of the PVC helps mitigate this.

Figure 10:
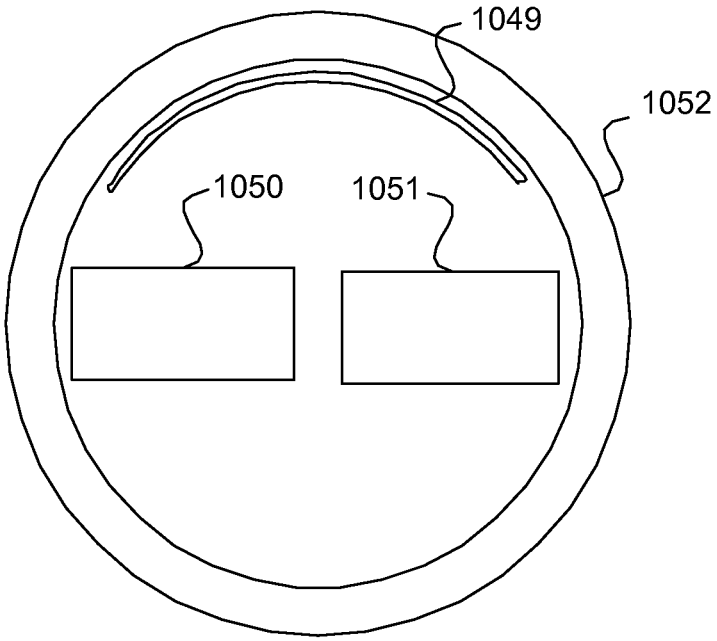
FIG. 10 is a sectional view drawing illustrating a horizontal section of a 902 MHz prototype in accordance with at least one embodiment.
Figure 11:
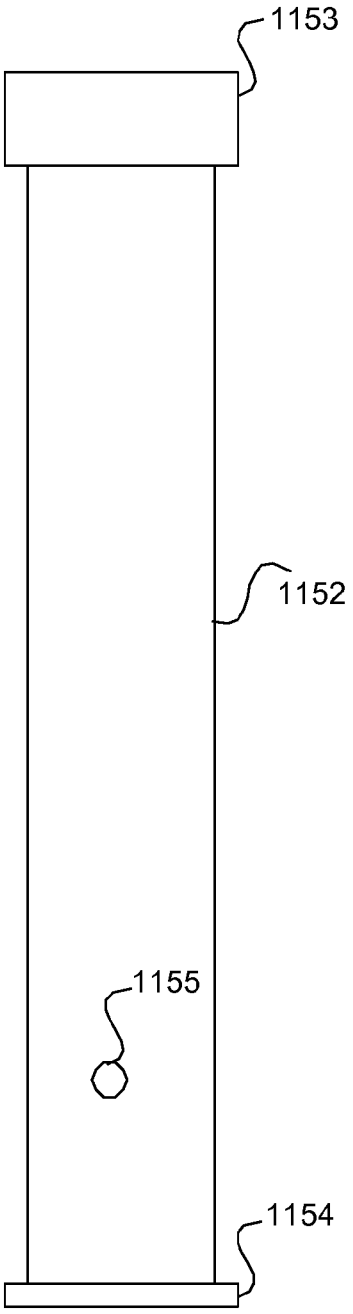
FIG. 11 is an elevation view drawing illustrating the 902 MHz prototype in accordance with at least one embodiment.

In accordance with at least one embodiment, nonconductive support members, such as, for example, wood slats, are inserted into a PVC tube and screwed to opposite side walls. These wooden slats form supports to which the coaxial elements are attached. FIG. 10 is a sectional view drawing illustrating a horizontal section of a 902 MHz prototype in accordance with at least one embodiment. In accordance with at least one embodiment, the helical collinear antenna comprises a PVC tube 1052, a first support member 1050, a second support member 1051, and flexible coaxial cable 1049, for example RG-316 TEFLON dielectric coaxial cable. As FIG. 10 is a sectional view, flexible coaxial cable 1049 is illustrated as a curved quasi-elliptical shape based on the portion of flexible coaxial cable 1049 lying in the plane of the section. In accordance with at least one embodiment, the helical collinear antenna comprises 11 turns of coaxial cable. In accordance with at least one embodiment, the first support member and the second support member comprise wood slats. In accordance with at least one embodiment, the first support member and the second support member comprise PVC tubes. FIG. 11 is an elevation view drawing illustrating the 902 MHz helical collinear prototype in accordance with at least one embodiment. The exterior of the antenna assembly comprises radome 1152, radome cap 1153, radome flange 1154, and coaxial connector 1155. Radome cap 1153 is coupled to one end of radome 1152, and radome flange 1154 is coupled to an opposite end of radome 1152. In accordance with at least one embodiment, coaxial connector 1155 is mounted in a side of radome 1152. In accordance with at least one embodiment, coaxial connector 1155 is mounted within radome flange 1154.

Teflon dielectric coaxial cable such as RG400 and RG316 may be used because it can withstand soldering temperatures without shorting. The velocity factor of Teflon dielectric coaxial cable is also somewhat higher than that of coaxial cable using some other type of dielectric material.

Figure 12:
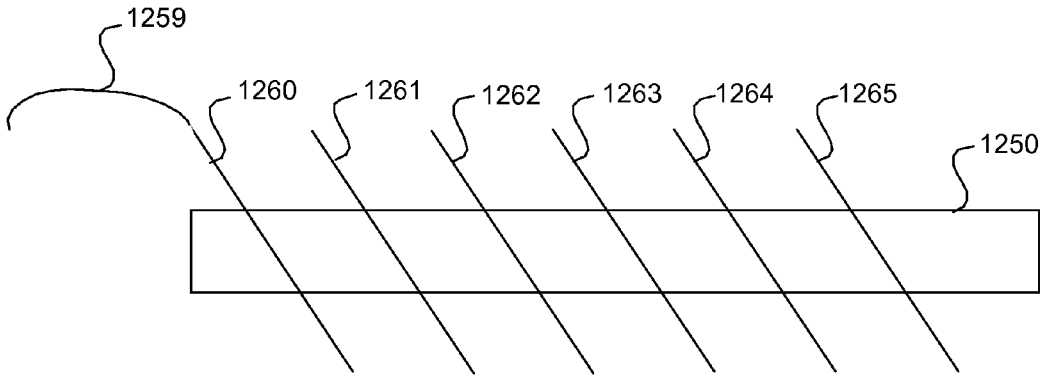
FIG. 12 is an elevation view diagram illustrating assembly of a 1296 MHz prototype array in accordance with at least one embodiment onto wooden support members.

FIG. 12 is an elevation view diagram illustrating assembly of a 1296 MHz prototype array in accordance with at least one embodiment onto support members. The array comprises turns 1260, 1261, 1262, 1263, 1264, and 1265 of the helical arrangement of elements. A coaxial transmission line 1259 is coupled to turn 1260 to connect the array to a coaxial connector at the feed point. Turns 1260, 1261, 1262, 1263, 1264, and 1265 are mounted on support member 1250, which may for example, be a wooden support member or a plastic support member. In accordance with at least one embodiment, support member 1250 is configured to be parallel to an axis of the helix. In accordance with at least one embodiment, the supports are pre-drilled prior to assembly. In accordance with at least one embodiment, during assembly, the wooden support members were "zip-tied" together. After all elements are arrayed along the support, the ties can be removed and the assembly can be inserted into the PVC tube. In accordance with at least one embodiment, heat shrink tubing was also used to cover and reinforce each junction. For additional mechanical support, in accordance with at least one embodiment, short lengths of tubing, for example TYGON tubing, EXCELON fuel line, or acrylic tubing, can be placed over the heat shrink tubing. For example, in accordance with at least one embodiment, for RG-316 coaxial cable, tubing with 3/16" OD and 3/32" ID has been successfully applied over junctions.

Figure 22:
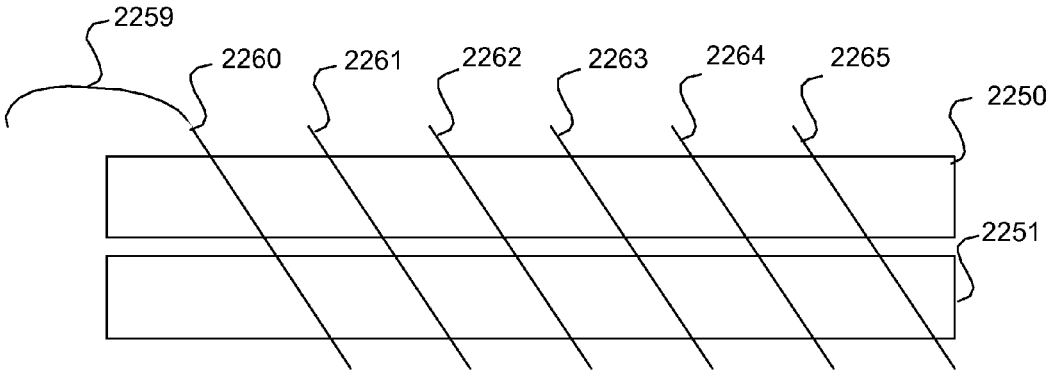
FIG. 22 is an elevation view diagram illustrating assembly of a 1296 MHz prototype array in accordance with at least one embodiment onto wooden support members.

FIG. 22 is an elevation view diagram illustrating assembly of a 1296 MHz prototype array in accordance with at least one embodiment onto wooden support members. FIG. 22 provides a view from an angle 90° from the angle of the view of FIG. 12. The array comprises turns 2260, 2261, 2262, 2263, 2264, and 2265 of the helical arrangement of elements. A coaxial transmission line 2259 is coupled to turn 2260 to connect the array to a coaxial connector at the feed point. Turns 2260, 2261, 2262, 2263, 2264, and 2265 are mounted on support members 2250 and 2251, which may for example, be wooden support members or plastic support members. In accordance with at least one embodiment, support members 2250 and 2251 are configured to be parallel to an axis of the helix.

At higher frequencies, such as ultra high frequency (UHF) and above, for example 902 MHz and 1296 MHz, element to element transitions should be kept extremely short. Parasitic inductance can have a significant cumulative effect on performance. In accordance with at least one embodiment, elements are pre-cut using a dial or digital calipers.

Figure 19:
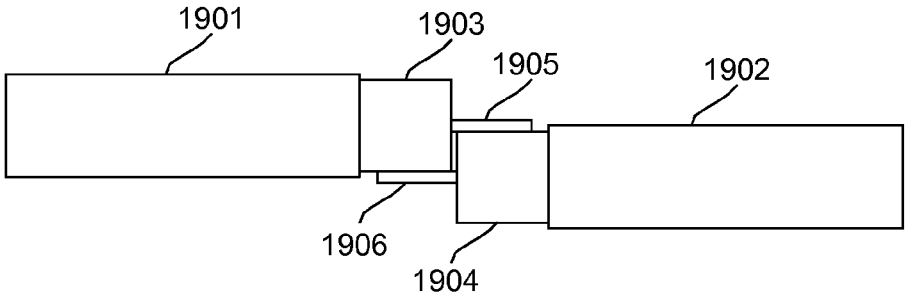
FIG. 19 is a diagram illustrating a junction of two coaxial elements in accordance with at least one embodiment.
Figure 20:
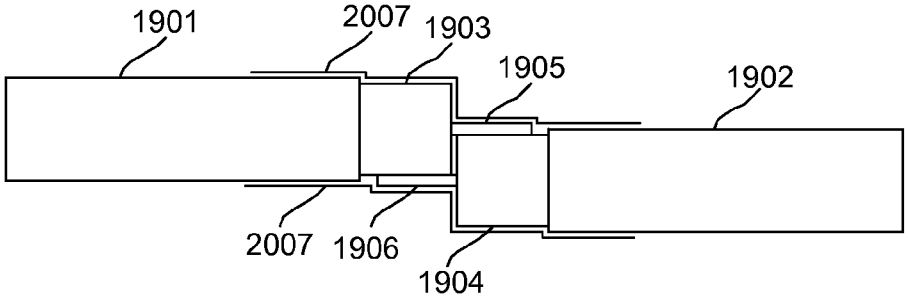
FIG. 20 is a diagram illustrating application of heat shrink tubing over a junction of two coaxial elements in accordance with at least one embodiment.
Figure 21:
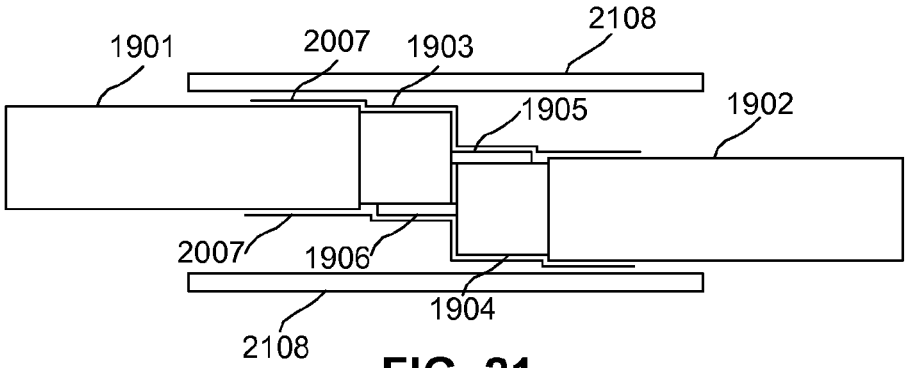
FIG. 21 is a diagram illustrating application of more rigid tubing over a junction of two coaxial elements in accordance with at least one embodiment.

FIG. 19 is a diagram illustrating a junction of two coaxial elements in accordance with at least one embodiment. A first coaxial element comprises center conductor 1905, shield conductor 1903, and sheath 1901. A second coaxial element comprises center conductor 1906, shield conductor 1904, and sheath 1902. Center conductor 1905 of the first coaxial element is soldered to shield conductor 1904 of the second coaxial element. Shield conductor 1903 of the first coaxial element is soldered to center conductor 1906 of the second coaxial element. A gap is maintained between shield conductor 1903 and shield conductor 1904 to prevent them from shorting, but the gap should be minimal, given mechanical tolerances, the operating voltage, etc. FIG. 20 is a diagram illustrating application of heat shrink tubing over a junction of two coaxial elements in accordance with at least one embodiment. Heat shrink tubing 2007 is fitted over the junction of FIG. 19 to improve environmental protection and mechanical stability. Hot melt adhesive filled heat shrink tubing may be used to further enhance environmental protection and mechanical stability. FIG. 21 is a diagram illustrating application of more rigid tubing over a junction of two coaxial elements in accordance with at least one embodiment. Tube 2108 is fitted over the junction of FIG. 19 or FIG. 20 to improve mechanical stability. In accordance with at least one embodiment, tube 2108 is rigid. In accordance with at least one embodiment, tube 2108 is fairly stiff but still flexible enough to conform somewhat to the shape of the junction. A sealant, such as electronic grade silicone sealant, may be applied to fill any gaps between tube 2108 and sheath 1901 and/or sheath 1902.

Figure 13:
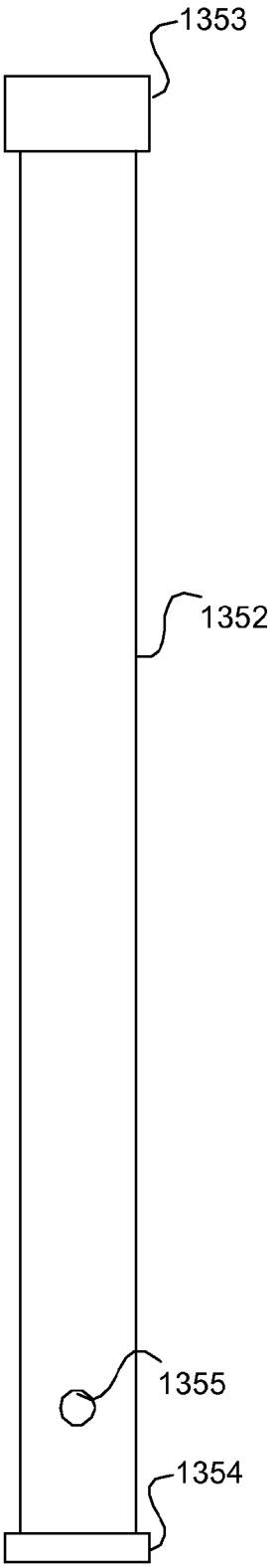
FIG. 13 is an elevation view diagram illustrating a completed 15 turn 1296 MHz antenna in accordance with at least one embodiment.

FIG. 13 is an elevation view diagram illustrating an exemplary completed 15 turn 1296 MHz antenna in accordance with at least one embodiment. The exterior of the antenna assembly comprises radome 1352, radome cap 1353, radome flange 1354, and coaxial connector 1355. Radome cap 1353 is coupled to one end of radome 1352, and radome flange 1354 is coupled to an opposite end of radome 1352. In accordance with at least one embodiment, coaxial connector 1355 is mounted in a side of radome 1352. In accordance with at least one embodiment, coaxial connector 1355 is mounted within radome flange 1354. Table 3 provides specifications for such an exemplary antenna. Table 4 provides the port definition used to model the exemplary 15 turn structure using the EZNEC analysis software.

TABLE 3

Helical Collinear Calculations for an Exemplary 1296 MHz Antenna

| | (inches) | (mm) | | | |
|---|---|---|---|---|---|
| Length of λ/2 | 3.20 | 81 | (0.35 λ) | Elements/Turn | 3 |
| Diameter | 2.85 | 72 | (0.31 λ) | Turns | 15 |
| Pitch | 3.46 | 88 | (0.38 λ) | Total Segments | 180 |
| Linear Total | 145.38 | 3693 | (15.94 λ) | N of λ/2 | 44 |
| Helix Length | 51.95 | 1320 | (5.70 λ) | Segments/Turn | 12 |
| Bottom | 5.91 | 150 | | | |
| Top | 57.85 | 1470 | | | |

TABLE 4

1296 MHz EZNEC Port Definition

| Element | | Linear (Inches) | Linear (mm) | Z-coordinate (mm) | Segments | Bottom Segment |
|---|---|---|---|---|---|---|
| 1 | λ/4 | 143.10 | 3635 | 1449 | 2 | 178 |
| 2 | λ/2 | 139.90 | 3553 | 1420 | 4 | 174 |
| 3 | λ/2 | 136.70 | 3472 | 1391 | 4 | 170 |
| 4 | λ/2 | 133.50 | 3391 | 1362 | 4 | 166 |
| 5 | λ/2 | 130.30 | 3310 | 1333 | 4 | 162 |
| 6 | λ/2 | 127.10 | 3228 | 1304 | 4 | 158 |
| 7 | λ/2 | 123.90 | 3147 | 1275 | 4 | 154 |
| 8 | λ/2 | 120.70 | 3066 | 1245 | 4 | 150 |
| 9 | λ/2 | 117.50 | 2984 | 1216 | 4 | 146 |
| 10 | λ/2 | 114.30 | 2903 | 1187 | 4 | 142 |
| 11 | λ/2 | 111.10 | 2822 | 1158 | 4 | 138 |
| 12 | λ/2 | 107.90 | 2741 | 1129 | 4 | 134 |
| 13 | λ/2 | 104.70 | 2659 | 1100 | 4 | 130 |
| 14 | λ/2 | 101.50 | 2578 | 1071 | 4 | 126 |
| 15 | λ/2 | 98.30 | 2497 | 1042 | 4 | 122 |

TABLE 4-continued

| 1296 MHz EZNEC Port Definition | | | | | | |
|---|---|---|---|---|---|---|
| Element | | Linear (Inches) | Linear (mm) | Z-coordinate (mm) | Segments | Bottom Segment |
| 16 | λ/2 | 95.10 | 2415 | 1013 | 4 | 118 |
| 17 | λ/2 | 91.90 | 2334 | 984 | 4 | 114 |
| 18 | λ/2 | 88.70 | 2253 | 955 | 4 | 110 |
| 19 | λ/2 | 85.50 | 2172 | 926 | 4 | 106 |
| 20 | λ/2 | 82.30 | 2090 | 897 | 4 | 102 |
| 21 | λ/2 | 79.10 | 2009 | 868 | 4 | 98 |
| 22 | λ/2 | 75.90 | 1928 | 839 | 4 | 94 |
| 23 | λ/2 | 72.70 | 1846 | 810 | 4 | 90 |
| 24 | λ/2 | 69.50 | 1765 | 781 | 4 | 86 |
| 25 | λ/2 | 66.30 | 1684 | 752 | 4 | 82 |
| 26 | λ/2 | 63.10 | 1603 | 723 | 4 | 78 |
| 27 | λ/2 | 59.90 | 1521 | 694 | 4 | 74 |
| 28 | λ/2 | 56.70 | 1440 | 665 | 4 | 70 |
| 29 | λ/2 | 53.50 | 1359 | 636 | 4 | 66 |
| 30 | λ/2 | 50.30 | 1278 | 607 | 4 | 62 |
| 31 | λ/2 | 47.10 | 1196 | 577 | 4 | 58 |
| 32 | λ/2 | 43.90 | 1115 | 548 | 4 | 54 |
| 33 | λ/2 | 40.70 | 1034 | 519 | 4 | 50 |
| 34 | λ/2 | 37.50 | 952 | 490 | 4 | 46 |
| 35 | λ/2 | 34.30 | 871 | 461 | 4 | 42 |
| 36 | λ/2 | 31.10 | 790 | 432 | 4 | 38 |
| 37 | λ/2 | 27.90 | 709 | 403 | 4 | 34 |
| 38 | λ/2 | 24.70 | 627 | 374 | 4 | 30 |
| 39 | λ/2 | 21.50 | 546 | 345 | 4 | 26 |
| 40 | λ/2 | 18.30 | 465 | 316 | 4 | 22 |
| 41 | λ/2 | 15.10 | 383 | 287 | 4 | 18 |
| 42 | λ/2 | 11.90 | 302 | 258 | 4 | 14 |
| 43 | λ/2 | 8.70 | 221 | 229 | 4 | 10 |
| 44 | λ/2 | 5.50 | 140 | 200 | 4 | 6 |
| 45 | λ/2 | 2.30 | 58 | 171 | 4 | 2 |
| 46 | λ/4 | 0.00 | 0 | 150 | 2 | 0 |

For lower frequencies where PVC tubing is not practical in the necessary dimensions, a turnstile support framework is provided in accordance with at least one embodiment.

Experimental Results

Figure 14:
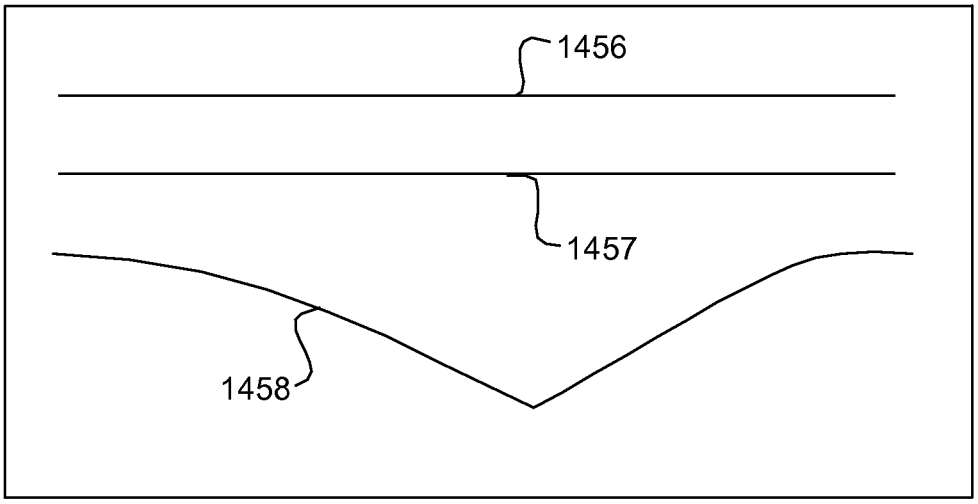
FIG. 14 is a drawing illustrating a network analyzer display of a comparison of an exemplary 15 turn 1296 MHz helical collinear antenna, in accordance with at least one embodiment, to a 1296 MHz "big wheel" antenna.

To date, prototype antennas of this type have been constructed and tested for 1296 MHz, 902 MHz, and 50 MHz (i.e., 6 meters), although the 50 MHz case was only a single turn. Good results have been obtained in each case. In an attempt to make a measurement of the gain relative to a "big wheel," a reference path was established between two "big wheels," then one was replaced by the 15 turn 1296 MHz helical collinear antenna. FIG. 14 is a drawing illustrating a network analyzer display of a comparison of an exemplary 15 turn 1296 MHz helical collinear antenna, in accordance with at least one embodiment, to a 1296 MHz "big wheel" antenna. The helical collinear trace 1456 on the CRT display shows the |S21| response (10 dB/division) for the helical collinear prototype antenna. The big wheel trace 1457 on the CRT display shows the |S21| response (10 dB/division) for the big wheel antenna. The distance between helical collinear trace 1456 and big wheel trace 1457 shows a measured gain of +12.5 dB for the helical collinear prototype antenna relative to the gain of the big wheel antenna. Voltage standing wave ratio (VSWR) trace 1458 shows the voltage standing wave ratio of the helical collinear prototype antenna over frequency. As the measurement was not performed on a proper antenna range, it is likely reflections were causing errors, so the measured +12.5 dB gain over a single "big wheel" is likely somewhat optimistic. Nonetheless, the measurements still show the omnidirectional gain offered from a helically wound coaxial collinear antenna in accordance with at least one embodiment can be quite good. The ease of feeding the array from a single point is also a very significant advantage in accordance with at least one embodiment.

Accordingly, a method and apparatus for an omnidirectional helically arrayed antenna is described. It should be understood that the implementation of other variations and modifications of the invention in its various aspects will be apparent to those of ordinary skill in the art, and that the invention is not limited by the specific embodiments described. It is therefore contemplated to cover by the present invention, any and all modifications, variations, or equivalents that fall within the spirit and scope of the basic underlying principles disclosed and claimed herein.

What is claimed is:

1. An antenna comprising:

a helical array of coaxial transmission line radiating elements coupled to one another successively by phase changing couplings, each of the coaxial transmission line radiating elements having a center conductor surrounded by a shield conductor;

a terminal element coupled to a distal end of the helical array;

a balun element coupled to the proximal end of the helical array;

a radome enclosing the balun element, the helical array, and the terminal element; and a coaxial connector coupled to the balun element.

2. The antenna of claim 1 wherein an electrical length of each of the coaxial transmission line radiating elements is an odd integer multiple of a value between 1.25 times a pitch of the helical array and 1.33 times the pitch of the helical array.

3. The antenna of claim 1 wherein the antenna is configured to provide an omnidirectional radiation pattern and a polarization dominated by a magnetic field vector component parallel to an axis of the helical array and an electric field vector component perpendicular to the axis of the helical array.

4. The antenna of claim 1 wherein the helical array comprises:

a first coaxial element;

a second coaxial element, wherein a first end of the second coaxial element is coupled phase discontinuously to the first coaxial element; and a third coaxial element, wherein the third coaxial element is coupled phase discontinuously to a second end of the second coaxial element, wherein at least a portion of a helix is formed by the first coaxial element, the second coaxial element, and the third coaxial element.

5. The antenna of claim 4 wherein the portion of the helix formed by the first coaxial element, the second coaxial element, and the third coaxial element is a first turn of the helix.

6. The antenna of claim 4 wherein the first coaxial element, the second coaxial element, and the third coaxial element each have an electrical length of half a wavelength of operation.

7. The antenna of claim 4 wherein the pitch of the helix is between a quarter a wavelength of operation and a half the wavelength of operation.

8. The antenna of claim 4 wherein the pitch of the helix is between 0.38 times a wavelength of operation and 0.40 times the wavelength of operation.

9. The antenna of claim 4 wherein a first physical length of the first coaxial element divided by a first propagation velocity constant of first coaxial element is between one times the pitch of the helix and two times the pitch of the helix, wherein a second physical length of the second coaxial element divided by a second propagation velocity constant of the second coaxial element is between one times the pitch of the helix and two times the pitch of the helix, and wherein a third physical length of the third coaxial element divided by a third propagation velocity constant of the third coaxial element is between one times the pitch of the helix and two times the pitch of the helix.

10. The antenna of claim 4 wherein the helical array further comprises:

a fourth coaxial element, wherein the fourth coaxial element is coupled phase discontinuously to the third coaxial element;

a fifth coaxial element, wherein the fifth coaxial element is coupled phase discontinuously to the fourth coaxial element; and a sixth coaxial element, wherein the sixth coaxial element is coupled phase discontinuously to the fifth coaxial element, wherein the helix further comprises the fourth coaxial element, the fifth coaxial element, and the sixth coaxial element.

11. The antenna of claim 10 wherein the first coaxial element, the second coaxial element, and the third coaxial element define a first turn of the helix and wherein the fourth coaxial element, the fifth coaxial element, and the sixth coaxial element define a second turn of the helix.

12. An antenna comprising:

a helical array of coaxial transmission line radiating elements coupled to one another successively by phase changing couplings, each of the coaxial transmission line radiating elements having a center conductor surrounded by a shield conductor, wherein the helical array of coaxial transmission line radiating elements comprises:

a first odd half wavelength multiple coaxial element;

a second odd half wavelength multiple coaxial element, the first odd half wavelength multiple coaxial element joined to the second odd half wavelength multiple coaxial element; and a third odd half wavelength multiple coaxial element, the second odd half wavelength multiple coaxial element joined to the third odd half wavelength multiple coaxial element.

13. The antenna of claim 12 further comprising:

a terminal element coupled to a distal end of the helical array;

a balun element coupled to the proximal end of the helical array;

a radome enclosing the balun element, the helical array, and the terminal array element; and a coaxial connector coupled to the balun element.

14. The antenna of claim 12 wherein a first center conductor of the first odd half wavelength multiple coaxial element is joined to a second shield conductor of the second odd half wavelength multiple coaxial element, and wherein a first shield conductor of the first odd half wavelength multiple coaxial element to a second center conductor of the second odd half wavelength multiple coaxial element.

15. The antenna of claim 12 wherein the first odd half wavelength multiple coaxial element is formed into a first portion of a helix, the second odd half wavelength multiple coaxial element is formed into a second portion of the helix, and the third odd half wavelength multiple coaxial element is formed into a third portion of the helix.

16. The antenna of claim 12 wherein an odd quarter wavelength multiple coaxial element is joined to the third odd half wavelength multiple coaxial element.

17. The antenna of claim 12 wherein a balun element is joined to the first odd half wavelength multiple coaxial element.

18. The antenna of claim 12 wherein the first odd half wavelength multiple coaxial element, the second odd half wavelength multiple coaxial element, and the third odd half wavelength multiple coaxial element together define a first turn of a helix.

19. The antenna of claim 18 wherein the helix has a pitch between half the electrical length of the first odd half wavelength multiple coaxial element and the electrical length of the first odd half wavelength multiple coaxial element.

20. An antenna comprising:

a helical array of coaxial transmission line radiating elements coupled to one another successively by phase changing couplings, each of the coaxial transmission line radiating elements having a center conductor surrounded by a shield conductor, wherein the helical array comprises:

a first coaxial element;

a second coaxial element, wherein a first end of the second coaxial element is coupled phase discontinuously to the first coaxial element;

a third coaxial element, wherein the third coaxial element is coupled phase discontinuously to a second end of the second coaxial element, wherein at least a portion of a helix is formed by the first coaxial element, the second coaxial element, and the third coaxial element;

a fourth coaxial element, wherein the fourth coaxial element is coupled phase discontinuously to the third coaxial element;

a fifth coaxial element, wherein the fifth coaxial element is coupled phase discontinuously to the fourth coaxial element; and a sixth coaxial element, wherein the sixth coaxial element is coupled phase discontinuously to the fifth coaxial element, wherein the helix further comprises the fourth coaxial element, the fifth coaxial element, and the sixth coaxial element;

a terminal coaxial element coupled to a distal end of the helical array; and a balun element coupled to a proximal end of the helical array.

* * * * *